US008186323B2

(12) United States Patent
Akimoto et al.

(10) Patent No.: US 8,186,323 B2
(45) Date of Patent: May 29, 2012

(54) INTAKE AIR NOISE ADJUSTER

(75) Inventors: Takayuki Akimoto, Atsugi (JP); Ichiro Fukumoto, Kodaira (JP); Masashi Shinada, Sayama (JP); Takashi Kawano, Kawagoe (JP)

(73) Assignees: Nissan Motor Co., Ltd., Yokohoma-shi (JP); Mahle Filter Systems Japan Corporation, Tokyo (JP)

( * ) Notice: Subject to any disclaimer, the term of this patent is extended or adjusted under 35 U.S.C. 154(b) by 631 days.

(21) Appl. No.: 12/174,150

(22) Filed: Jul. 16, 2008

(65) Prior Publication Data

US 2009/0025672 A1 Jan. 29, 2009

(30) Foreign Application Priority Data

Jul. 26, 2007 (JP) ..... 2007-194256
Mar. 24, 2008 (JP) ..... 2008-075266

(51) Int. Cl.
*F02M 35/10* (2006.01)

(52) U.S. Cl. ..... 123/184.53; 123/184.54

(58) Field of Classification Search ..... 123/583, 123/584, 184.32, 547, 59.5, 597, 184.33, 123/581, 582, 342, 337, 73 A; 261/23.2, 261/65, 23.1, 23.3, 41.1, 41.3; *F02M 35/10*
See application file for complete search history.

(56) References Cited

U.S. PATENT DOCUMENTS

| | | | | |
|---|---|---|---|---|
| 3,867,487 | A * | 2/1975 | Matsumoto | 261/41.5 |
| 4,050,419 | A * | 9/1977 | Harpman et al. | 123/3 |
| 4,086,885 | A * | 5/1978 | Noguchi et al. | 123/274 |
| 4,089,308 | A * | 5/1978 | Pierlot | 123/442 |
| 4,151,821 | A * | 5/1979 | Wichman et al. | 123/523 |
| 4,240,390 | A * | 12/1980 | Takeda | 123/480 |
| 6,173,939 | B1 * | 1/2001 | Dottavio et al. | 251/129.12 |
| 6,600,408 | B1 * | 7/2003 | Walter et al. | 340/384.1 |
| 2003/0136119 | A1 * | 7/2003 | Marks et al. | 60/312 |
| 2007/0131189 | A1 | 6/2007 | Shinada et al. | |

FOREIGN PATENT DOCUMENTS

| | | | |
|---|---|---|---|
| CN | 1945000 | A | 4/2004 |
| JP | 2005-139982 | A | 6/2005 |
| JP | 2007-2681 | A | 1/2007 |

* cited by examiner

*Primary Examiner* — Noah Kamen
*Assistant Examiner* — Keith Coleman
(74) *Attorney, Agent, or Firm* — Foley & Lardner LLP

(57) ABSTRACT

An intake air noise adjuster includes: a communicating conduit including: a first end communicating to an intake air passage to an engine, and a second end communicating to an external air; an elastic body configured to block the communicating conduit; and a flow channel area changer configured to change a flow channel area of the communicating conduit based on a change of an intake air negative pressure caused in the intake air passage.

34 Claims, 9 Drawing Sheets

INTAKE AIR NOISE ADJUSTER

BACKGROUND OF THE INVENTION

1. Field of the Invention

The present invention relates to a device for improving intake air noise (intake air tone) caused from an intake air system of a vehicle and the like.

2. Description of the Related Art

An intake air noise adjuster capable of causing a vigorous intake air noise by introducing an intake air noise (caused to an intake air passage to an engine) in a vehicle compartment during traveling is conventionally known.

Japanese Patent Application Laid-Open No. 2005-139982 (=JP2005139982) discloses an intake air noise adjuster (referred to as "tone quality control device") including a communicating conduit, an elastic body and an additional conduit.

On an outer periphery of an intake air duct, the communicating conduit is mounted in a position further away from an engine than a position where a throttle chamber 8 for increasing and decreasing intake air amount of the engine is disposed. As such, the communicating conduit communicates with the intake air duct.

The elastic body blocks the communicating conduit, and vibrates according to an intake air pulsation in the intake air duct.

The additional conduit has a first open end connected to the communicating conduit and a second open end open to an external air.

In the conventional intake air noise adjuster, the elastic body vibrates according to the intake air pulsation caused in a gas in the intake air duct. As such, the intake air noise is radiated outwardly to the external air from the second open end of the additional conduit, thus introducing a rigorous intake air noise into the vehicle compartment.

With the related intake air noise adjuster of JP2005139982, irrespective of driver's depressing of an accelerator pedal, the intake air noise is increased according to the intake air pulsation caused in the gas in the intake air duct.

Therefore, the intake air noise is unintentionally increased even in the following states for securing silence: relaxed acceleration, idling and the like when the driver's depressing of the accelerator pedal is small.

SUMMARY OF THE INVENTION

It is an object of the present invention to provide an intake air noise adjuster capable of relieving an effect of increasing an intake air noise so as to secure silence in such a state as relaxed acceleration, idling and the like.

According to a first aspect of the present invention, an intake air noise adjuster comprises: a communicating conduit including: a first end communicating to an intake air passage to an engine, and a second end communicating to an external air; an elastic body configured to block the communicating conduit; and a flow channel area changer configured to change a flow channel area of the communicating conduit based on a change of an intake air negative pressure caused in the intake air passage.

According to a second aspect of the present invention, an intake air noise adjuster comprises: a communicating means including: a first end communicating to an intake air means to an engine, and a second end communicating to an external air; an elastic means for blocking the communicating means; and a flow channel area changing means for changing a flow channel area of the communicating means based on a change of an intake air negative pressure caused in the intake air means.

Other objects and features of the present invention will become understood from the following description with reference to the accompanying drawings.

DESCRIPTION OF THE PREFERRED EMBODIMENTS

In the following, various embodiments of the present invention will be described in detail with reference to the accompanying drawings.

For ease of understanding, the following description will contain various directional terms, such as left, right, upper, lower, forward, rearward and the like. However, such terms are to be understood with respect to only a drawing or drawings on which the corresponding part of element is illustrated.

First Embodiment (Structure)

Figure 1:
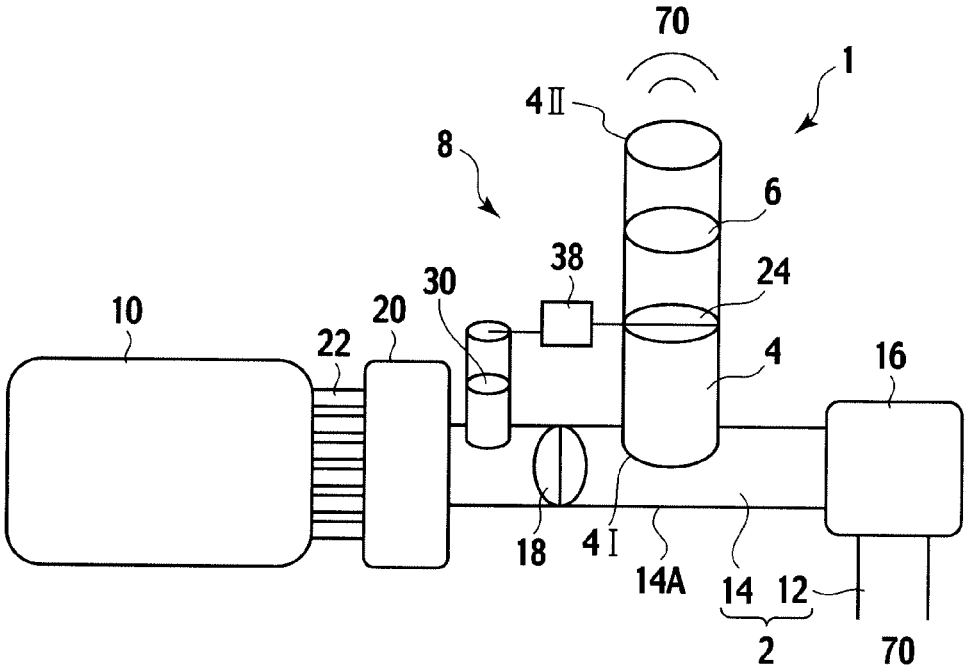
FIG. 1 shows an entire structural concept of an intake air noise adjuster, according to a first embodiment of the present invention.

FIG. 1 shows an entire structural concept of an intake air noise adjuster 1, according to a first embodiment of the present invention. FIG. 1 is, however, also applicable to second, third and fourth embodiments, to be described afterward.

As shown in FIG. 1, the intake air noise adjuster 1 of the first embodiment is mounted to an intake air duct 2 (otherwise referred to as "intake air passage 2") and includes a communicating conduit 4, an elastic body 6 and a flow channel area changer 8.

At first set forth are the intake air duct 2 and components related to the intake air duct 2.

The intake air duct 2 serves as an intake air passage from an external air 70 to an engine 10 and includes a dust side intake air duct 12 and a clean side intake air duct 14.

A first open end of the dust side intake air duct 12 is connected to an air cleaner 16, while a second open end of the dust side intake air duct 12 is open to an external air 70.

The air cleaner 16 has, for example, a filter part such as an oil filter, and purifies a gas from the second open end of the dust side intake air duct 12 through the filter part.

The clean side intake air duct 14 has a throttle chamber 18.

A first open end of the clean side intake air duct 14 is connected to the air cleaner 16. By way of a surge tank 20 (to be described afterward) and each of intake manifolds 22 (to be described afterward), a second open end of the clean side intake air duct 14 is connected to each cylinder (not shown) of the engine 10.

The throttle chamber 18 is mounted between the air cleaner 16 and the surge tank 20 and is connected to an accelerator pedal (not shown). Moreover, according to a driver's accelerator pedal depression, the throttle chamber 18 changes its opening, thereby changing air vent amount from the air cleaner 16 to the surge tank 20.

Specifically, when the driver decreases the accelerator pedal depression (hereinafter referred to as "relaxed acceleration"), the opening of the throttle chamber 18 is decreased, to thereby decrease the air vent amount from the air cleaner 16 to the surge tank 20. Then, an intake air negative pressure caused in the gas in the clean side intake air duct 14 is decreased.

The thus decreased opening of the throttle chamber 18 brings about the following phenomena to the intake air negative pressure caused in the clean side intake air duct 14: The intake air negative pressure caused to the engine 10 side of the throttle chamber 18 (hereinafter referred to as "engine side intake air negative pressure") increases.

Figure 2:
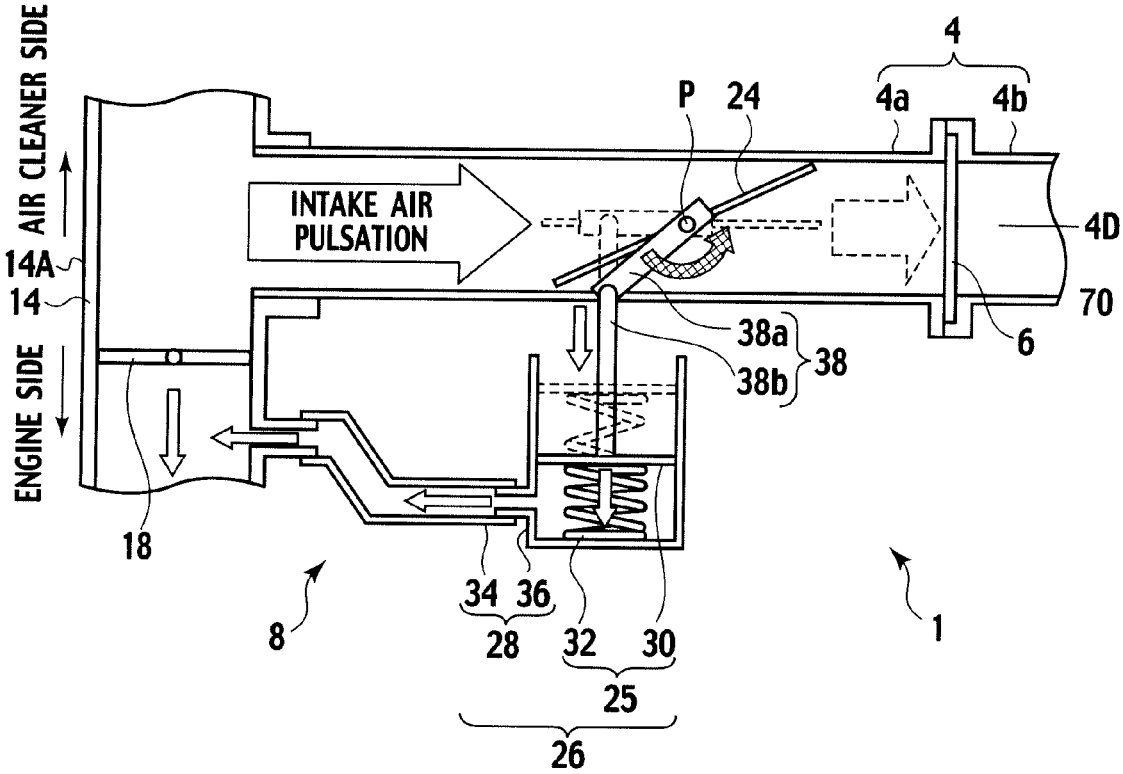
FIG. 2 shows a state of a flow channel area changer during an idling or relaxed acceleration period, according to the first embodiment of the present invention.

Then, a zero (0) opening of the throttle chamber 18 divides the clean side intake air duct 14 into two: one is the engine 10 side of the throttle chamber 18 and the other is a part further away from the engine 10 than the throttle chamber 18. In other words, closing the throttle chamber 18 maximizes the intake air negative pressure on the engine 10 side. FIG. 2 shows a state that the throttle chamber 18 is closed.

In addition, the zero (0) opening of the throttle chamber 18, in other words, the closing of the throttle chamber 18 includes the engine 10's idling state where the driver is free from depressing the accelerator pedal. The zero (0) opening of the throttle chamber 18 also includes transition from i) a traveling state where the driver depresses the accelerator pedal to ii) a stop state where the driver stops depressing the accelerator pedal.

Figure 3:
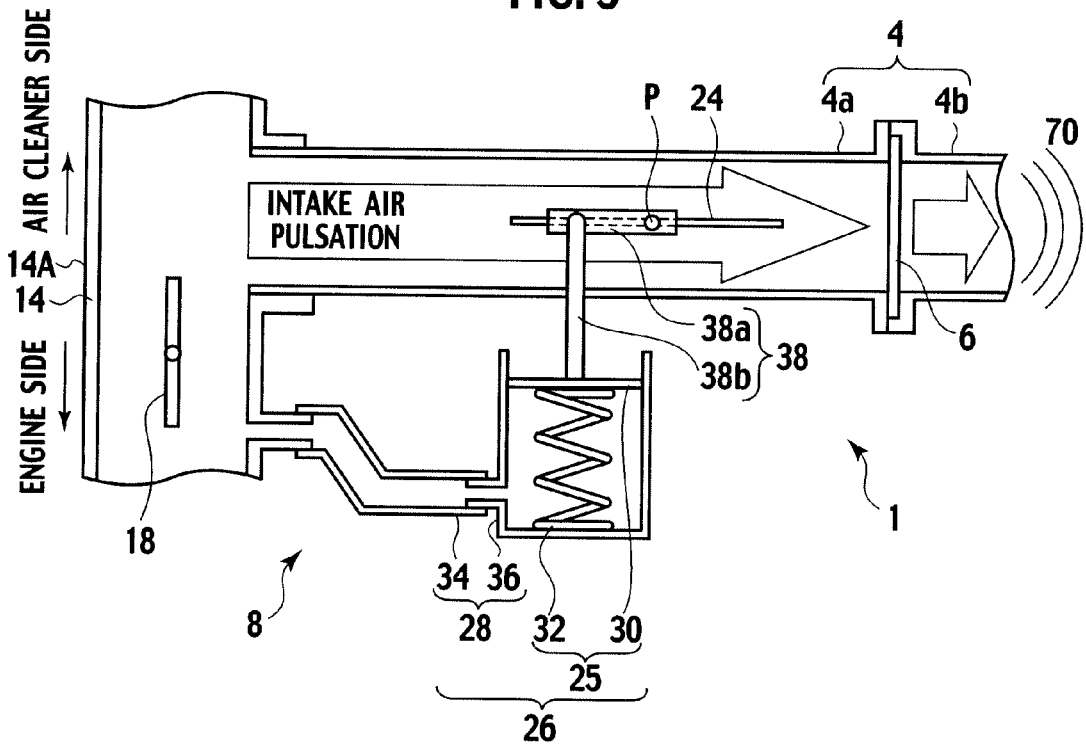
FIG. 3 shows a state of the flow channel area changer during a rapid acceleration period, according to the first embodiment of the present invention.

Meanwhile, increasing the accelerator pedal depression (hereinafter referred to as "rapid acceleration") increases the opening of the throttle chamber 18, thereby increasing the air vent amount from the air cleaner 16 to the surge tank 20. Then, the intake air negative pressure caused in the gas in the clean side intake air duct 14 is increased. FIG. 3 shows a state that the opening of the throttle chamber 18 is maximized.

As such, increasing the opening of the throttle chamber 18 from the throttle chamber 18's closed state to full-open state decreases the negative pressure on the engine 10 side.

In an intake stroke, the engine 10 makes the following operations: By way of the surge tank 20 and each of the intake manifolds 22 to each of the cylinders (not shown), taking in (absorbing) the gas entering from the second open end of the dust side intake air duct 12 and present in the clean side intake air duct 14.

Moreover, the engine 10 serves as a pressure source for causing an intake air pulsation to the gas present in the clean side intake air duct 14. It is the intake air pulsation that causes an intake air noise.

Herein, the intake air pulsation caused according to the intake air operation by the engine 10 is a pressure fluctuation caused to the gas present in the clean side intake air duct 14. This pressure fluctuation has a plurality of frequencies. That is, the intake air pulsation caused according to the intake air operation by the engine 10 has an intake air pulsation having a plurality of frequencies.

<Structures of Communicating Conduit 4, Elastic Body 6 and Flow Channel Area Changer 8>

Hereinafter set forth are structures of the communicating conduit 4, elastic body 6 and flow channel area changer 8.

The communicating conduit 4 is shaped substantially into a cylinder and has a first end 4I mounted to a certain position on an outer periphery 14A of the clean side intake air duct 14 where the above certain position is disposed further away from the engine 10 than a position where the throttle chamber 18 is disposed. With the above structure, the first end 4I of the communicating conduit 4 communicates to the intake air passage 2 of the engine 10. Meanwhile, a second end 4II of the communicating conduit 4 communicates to the external air 70.

The elastic body 6 which is made of, for example, an elastic resinous material is shaped substantially into a circular plate. Mounting the elastic body 6 on an inner periphery of the communicating conduit 4 blocks the communicating conduit 4. Moreover, elastically deforming the elastic body 6 according to the intake air pulsation caused in the clean side intake air duct 14 vibrates the elastic body 6 facially outwardly.

<Flow Channel Area Changer 8>

Hereinafter, the structure of the flow channel area changer 8 is to be set forth in detail, referring to FIG. 2 and FIG. 3.

FIG. 2 and FIG. 3 each show details of the structure of the flow channel area changer 8. FIG. 2 shows a state of the flow channel area changer 8 during the relaxed acceleration or idling, while FIG. 3 shows a state of the flow channel area changer 8 during the rapid acceleration period.

As shown in FIG. 2 and FIG. 3, the flow channel area changer 8 has a flow channel area changing part 24 and a displacer 26.

In view of cross section, the flow channel area changing part 24 corresponds to the communicating conduit 4. Specifically, the flow channel area changing part 24 is a plate member shaped into an ellipse and is disposed more on the clean side intake air duct 14 side than the elastic body 6 is disposed.

Moreover, the flow channel area changing part 24 is supported to the communicating conduit 4 in such a configuration as to displaceably rotate around an axis P intersecting with a lengthwise direction 4D of the communicating conduit 4. In FIG. 2 and FIG. 3, the flow channel area changing part 24's rotary center with respect to the communicating conduit 4 is denoted by "P."

In the communicating conduit 4, rotating and thereby displacing the flow channel area changing part 24 changes a flow channel area of the gas (hereinafter referred to as simply "flow channel area") moving between the clean side intake air duct 14 and the elastic body 6. Hereinabove, FIG. 2 shows a semicircular arrow for denoting a direction of displacing the flow channel area changing part 24.

Specifically, rotating and thereby displacing the flow channel area changing part 24 in the communicating conduit 4 inclines a longitudinal direction of the flow channel area changing part 24 relative to the lengthwise direction 4D of the communicating conduit 4. In this operation, the increased inclination decreases the opening of the communicating conduit 4, thus decreasing the flow channel area smaller than the maximum.

When the above inclination (the longitudinal direction of the flow channel area changing part 24, relative to the lengthwise direction 4D of communicating conduit 4) increases to such an extent as to allow the flow channel area changing part 24 to contact the inner periphery of the communicating conduit 4, the clean side intake air duct 14 is blocked from the elastic body 6. In this state, the flow channel area is minimized.

Moreover, rotating and thereby displacing the flow channel area changing part 24 in the communicating conduit 4 increases the opening of the communicating conduit 4, in the process from a first state (the longitudinal direction of the flow channel area changing part 24 is inclined relative to the lengthwise direction 4D of the communicating conduit 4) to a second state (the longitudinal direction of the flow channel area changing part 24 is substantially parallel to the lengthwise direction 4D of the communicating conduit 4), to thereby lead the flow channel area more and more to the maximum.

Then, as shown in FIG. 3, the longitudinal direction of the flow channel area changing part 24 becoming parallel to the lengthwise direction 4D of the communicating conduit 4 maximizes the opening of the communicating conduit 4, thus maximizing the flow channel area.

The displacer 26 includes a negative pressure introducing chamber 28, a blocking plate 30 and a blocking plate biasing member 32.

The negative pressure introducing chamber 28 includes an introducing conduit 34 and a cylindrical part 36.

The introducing conduit 34 is formed of, for example, a steel pipe which is shaped substantially into a cylinder.

The introducing conduit 34 has a first end which is mounted to the outer periphery 14A of the clean side intake air duct 14, specifically, mounted in a position closer to the engine 10 than a position where the throttle chamber 18 is mounted. As such, the introducing conduit 34 communicates with the clean side intake air duct 14. A second end of the introducing conduit 34 communicates with the cylindrical part 36.

Like the introducing conduit 34, the cylindrical part 36 is formed of a steel pipe which is shaped into a cylinder larger in diameter than the cylinder of the introducing conduit 34. The cylindrical part 36 has an axis which is substantially parallel to a lengthwise direction of the clean side intake air duct 14.

A first end of the cylindrical part 36 is open to the communicating conduit 4, while a second end of the cylindrical part 36 is blocked to form a base face. An outer periphery of the cylindrical part 36 is formed with an opening part which communicates with the second end of the introducing conduit 34, thus communicating the introducing conduit 34 with the cylindrical part 36.

According to a cross section of the cylindrical part 36, the blocking plate 30 is formed substantially into a circle. In the cylindrical part 36, the blocking plate 30 is slidable relative to an inner periphery of the cylindrical part 36, thus blocking the negative pressure introducing chamber 28.

Moreover, the blocking plate 30 is connected to the flow channel area changing part 24 via a connector 38.

The connector 38 includes a flow channel area changing part side connector 38*a* mounted to the flow channel area changing part 24 and a blocking plate side connector 38*b* mounted to the blocking plate 30.

The connector 38*a* is formed into a rod and mounted in such a configuration as to be parallel to the flow channel area changing part 24. The connector 38*a* has a first end which is supported to the communicating conduit 4 in such a configuration as to be coaxial with the rotary center P of the flow channel area changing part 24, and a second end which is connected to the connector 38*b*.

The connector 38*b* is formed into a bar. A first end of the connector 38*b* is supported to the connector 38*a* in such a configuration as to displaceably rotate around an axis intersecting with the lengthwise direction 4D of the communicating conduit 4, while a second end of the connector 38*b* is connected to the communicating conduit 4 side of the blocking plate 30.

The blocking plate biasing member 32 is, for example, a coil spring. A first end of the blocking plate biasing member 32 is mounted to the blocking plate 30's side opposite to the communicating conduit 4 side of the block plate 30, while a second end of the blocking plate biasing member 32 is mounted to the base face of the cylindrical part 36. As such, the blocking plate biasing member 32 can extend and shrink in a direction along an axis of the cylindrical part 36.

Spring constant of the blocking plate biasing member 32 is so set that the blocking plate 30 is allowed to move toward the base face of the cylindrical part 36 when the engine side intake air pressure is more than or equal to a certain pressure. FIG. 2 shows blank arrows denoting flow of the engine side intake air negative pressure.

The blocking plate 30 moving toward the base face of the cylindrical part 36 rotates and thereby displaces the flow channel area changing part 24 such that the flow channel area is smaller than the maximum. In this case, the blocking plate biasing member 32 has the spring constant making the following operation: As shown in FIG. 2, the flow channel area changing part 24 is rotated and thereby displaced in the communicating conduit 4, thus allowing the blocking plate 30 to move toward the base face of the cylindrical part 36 until the flow channel area changing part 24 contacts the inner periphery of the communicating conduit 4.

In other words, the blocking plate biasing member 32 has the spring constant making the following operation: Allowing the blocking plate 30 to move toward the base face of the cylindrical part 36 until the flow channel area changing part 24 blocks the clean side intake air duct 14 from the elastic body 6.

Moreover, the spring constant of the blocking plate biasing member 32 is so set that when the engine side intake air negative pressure is less than the certain pressure, the blocking plate biasing member 32 biases the blocking plate 30 and thereby moves the blocking plate 30 toward the communicating conduit 4 side, as shown in FIG. 3.

The blocking plate 30 moving toward the communicating conduit 4 rotates and thereby displaces the flow channel area changer 24 such that the flow channel area is maximized.

Herein, the "certain pressure" is defined as the engine side intake air negative pressure that is obtained in the following states which are not proper for increasing the intake air noise:

1) during a relaxed acceleration period when the driver's depressing of the accelerator pedal is small and therefore the driver's intention of acceleration is weak.

2) during an idling period when the driver is not depressing the accelerator pedal.

Therefore, the flow channel area changer 8 is capable of displacing the flow channel area changing part 24 according to change of the engine side intake air negative pressure.

Moreover, the displacer 26 is capable of displacing the flow channel area changing part 24 for accomplishing the following operations:

1) with the engine side intake air negative pressure less than the certain pressure, maximizing the flow channel area.

2) with the engine side intake air negative pressure more than or equal to the certain pressure, making the flow channel area smaller than the maximum.

As set forth above, the displacer 26 includes an opening changer 25 for making the following operations:

1) with the engine side intake air negative pressure more than or equal to the certain pressure, displacing the flow channel area changing part 24 in the direction of decreasing the opening of the communicating conduit 4.

2) with the engine side intake air negative pressure less than the certain pressure, displacing the flow channel area changing part 24 in the direction of increasing the opening of the communicating conduit 4.

Moreover, the opening changer 25 includes the blocking plate 30 and the blocking plate biasing member 32.

Moreover, as shown in FIG. 2 and FIG. 3, the communicating conduit 4 include a first communicating part 4*a* and a second communicating part 4*b*.

The first communicating part 4*a* is disposed in a position closer to the clean side intake air duct 14 than a position where the second communicating part 4*b* is disposed, and communicates to the clean side intake air duct 14. As such, the first communicating part 4*a* communicates with the intake air passage 2 of the engine 10.

The second communicating part 4*b* is disposed on a side further away from the clean side intake air duct 14 than a side where the first communicating part 4*a* is disposed, in other words, the second communicating part 4*b* is disposed more on the external air 70 side than the first communicating part 4*a* is disposed.

In addition, the elastic body 6 between the first communicating part 4*a* and the second communicating part 4*b* is mounted to the inner periphery of the communicating conduit 4, thus blocking the communicating conduit 4, specifically, blocking the first communicating part 4*a*.

Herein, the first communicating part 4*a* and the second communicating part 4*b* are so configured that a first resonant frequency caused by the first communicating part 4*a* and the elastic body 6 is resonant with a second resonant frequency caused by the second communicating part 4*b* and the elastic body 6.

The above configuration for the first resonant frequency resonant with the second resonant frequency is, for example, such that the first communicating part 4*a* and the second communicating part 4*b* are substantially the same in tubular length and cross section.

(Operation)

Then, operations of the intake air noise adjuster 1 according to the first embodiment are to be set forth.

After the engine 10 is driven, the intake air pulsation caused according to the intake air operation by the engine 10 is propagated, via the intake manifold 22 and surge tank 20, to the gas present in the clean side intake air duct 14 (see FIG. 1).

Herein, 1) during the idling period when the driver is not depressing the accelerator pedal or 2) during the relaxed acceleration period when the driver's depressing of the accelerator pedal is small and the driver's intention of acceleration is weak, the engine side intake air negative pressure is more than or equal to the certain pressure (see FIG. 2) since the opening of the throttle chamber 18 is small in the above states 1) and 2).

The engine side intake air negative pressure more than or equal to the certain pressure renders the pressure in the negative pressure introducing chamber 28 negative, thereby shrinking the blocking plate biasing member 32 and allowing the blocking plate 30 to slide relative to the inner periphery of the cylindrical part 36 to reach the base face of the cylindrical part 36 (see FIG. 2).

With the blocking plate 30 moving toward the base face of the cylindrical part 36, the blocking plate side connector 38*b* moves toward the base face of the cylindrical part 36. Then, toward the outer periphery of the communicating conduit 4 and relative to the connector 38*b*, the connector 38*a* rotates around the axis intersecting with the lengthwise direction 4D of the communicating conduit 4 (see FIG. 2).

The above rotation of the connector 38*a* rotates and thereby displaces the flow channel area changing part 24 in the communicating conduit 4, thus decreasing the flow channel area smaller than the maximum (see FIG. 2).

In this case, the flow channel area changing part 24 contacting the inner periphery of the communicating conduit 4 blocks the clean side intake air duct 14 from the elastic body 6, thereby minimizing the flow channel area (see FIG. 2).

As such, the intake air pulsation caused according to the intake air operation by the engine 10 and propagated to the gas present in the clean side intake air duct 14 is suppressed from propagating to the elastic body 6, to thereby suppress vibration of the elastic body 6 (see FIG. 2).

As such, during the idling or relaxed acceleration period, the flow channel area is decreased from the maximum and the intake air pulsation propagated to the gas present in the clean side intake air duct 14 is suppressed from propagating to the elastic body 6, to thereby suppress vibration of the elastic body 6. Thereby, the effect of increasing the intake air noise can be relieved (see FIG. 2).

Moreover, during the idling or relaxed acceleration period, blocking the clean side intake air duct 14 from the elastic body 6 minimizes the flow channel area, thus greatly relieving the effect of increasing the intake air noise. As such, the intake air noise introduced into the vehicle compartment is rendered slight (see FIG. 2).

Meanwhile, during the rapid acceleration period when the driver's depressing of the accelerator pedal is large and the driver's intention of acceleration is strong, the opening of the throttle chamber 18 is large. As such, the intake air negative pressure caused in the gas in the clean side intake air duct 14 during the intake stroke of the engine 10 becomes greater than that caused during the relaxed acceleration period, rendering the engine side intake air negative pressure less than the certain pressure (see FIG. 3).

The engine side intake air negative pressure less than the certain pressure makes the following operations (see FIG. 3):

1) rendering the pressure in the negative pressure introducing chamber 28 from negative to positive, 2) elongates the blocking plate biasing member 32, and 3) allowing the blocking plate 30 to slide relative to the inner periphery of the cylindrical part 36 so as to move the blocking plate 30 to the communicating conduit 4 side.

The blocking plate 30 moving toward the communicating conduit 4 causes the following operations (see FIG. 3):

1) the connector 38*b* moves to the communicating conduit 4 side.

2) toward the center of the communicating conduit 4 and relative to the connector 38*b*, the connector 38*a* rotates around the axis intersecting with the lengthwise direction 4D of the communicating conduit 4.

The above operation of the connector 38*a* rotates and thereby displaces the flow channel area changing part 24 in the communicating conduit 4 such that the flow channel area changing part 24 is released from the inner periphery of the communicating conduit 4. Then, the clean side intake air duct 14 communicates with the elastic body 6 (see FIG. 3).

The clean side intake air duct 14 communicates with the elastic body 6 such that the longitudinal direction of the flow channel area changing part 24 is substantially parallel to the lengthwise direction 4D of the communicating conduit 4, thus maximizing the flow channel area (see FIG. 3).

As such, the intake air pulsation caused according to the intake air operation by the engine 10 and propagated to the gas present in the clean side intake air duct 14 is propagated to the elastic body 6, thus vibrating the elastic body 6 facially outwardly. Then, the increased intake air noise is radiated outwardly to the external air 70 from the second open end of the communicating conduit 4 (see FIG. 1).

As such, during the rapid acceleration period, the flow channel area is maximized and the intake air pulsation propagated to the elastic body 6 vibrates the elastic body 6 facially outwardly, thus increasing the intake air noise which contributes to a production of the acceleration feeling (see FIG. 3).

(Effect of First Embodiment)

(1) The intake air noise adjuster 1 according to the first embodiment brings about the following effect:

With the change of the engine side intake air negative pressure, the flow channel area changer 8 can change the flow channel area of the gas moving between the intake air duct 2 and the elastic body 6.

As such, with the engine side intake air negative pressure more than or equal to the certain pressure, in other words, during the relaxed acceleration or idling period, the clean side intake air duct 14 is blocked from the elastic body 6, thus decreasing the flow channel area smaller than the maximum.

Meanwhile, with the engine side intake air negative pressure less than the certain pressure, in other words, during the rapid acceleration period, the clean side intake air duct 14 communicates with the elastic body 6, thus maximizing the flow channel area.

As such, during the relaxed acceleration or idling period for securing silence, the intake air pulsation propagated to the gas present in the clean side intake air duct 14 is suppressed from propagating to the elastic body 6, thus suppressing the vibration of the elastic body 6, to thereby relieve the effect of increasing the intake air noise.

Meanwhile, during the rapid acceleration period by the driver's strong intention of acceleration, the intake air pulsation propagated to the elastic body 6 vibrates the elastic body 6 facially outwardly, thus radiating the increased intake air noise outwardly to the external air 70 from the second open end of the communicating conduit 4.

As a result, the silence during the relaxed acceleration or idling period as well as the increased intake air noise during the rapid acceleration period each can be accomplished, thus producing a sporty sound without discomforting the driver or passenger of the vehicle.

(2) Moreover, with the intake air noise adjuster 1 according to the first embodiment, the engine side intake air negative pressure more than or equal to the certain pressure allows the flow channel area changing part 24 to contact the inner periphery of the communicating conduit 4, thus blocking the clean side intake air duct 14 from the elastic body 6.

As such, with the engine side intake air negative pressure more than or equal to the certain pressure, the intake air pulsation propagated to the gas present in the clean side intake air duct 14 is suppressed from propagating to the elastic body 6, and thereby suppresses the vibration of the elastic body 6, thus greatly relieving the effect of increasing the intake air noise.

As a result, during the relaxed acceleration or idling period when the engine side intake air negative pressure is more than or equal to the certain pressure, the effect of increasing the intake air noise can be greatly relieved, thereby the intake air noise introduced into the vehicle compartment is slight.

(3) Moreover, with the intake air noise adjuster 1 according to the first embodiment, the flow channel area changer 8 includes i) the flow channel area changing part 24 for changing the flow channel area of the communicating conduit 4 and ii) the displacer 26 for displacing the flow channel area changing part 24 according to the change of the intake air negative pressure in the intake air duct 2.

As a result, the change of the intake air negative pressure in the intake air duct 2 can displace the flow channel area changing part 24, without the need of an actuator and the like.

(4) Moreover, with the intake air noise adjuster 1 according to the first embodiment, the displacer 26 includes the negative pressure introducing chamber 28 and the opening changer 25. The negative pressure introducing chamber 28 communicates with the intake air duct 2. With the intake air negative pressure more than or equal to the certain pressure, the opening changer 25 displaces the flow channel area changing part 24 in the direction of decreasing the opening of the communicating conduit 4. Meanwhile, with the intake air negative pressure less than the certain pressure, the opening changer 25 displaces the flow channel area changing part 24 in the direction of increasing the opening of the communicating conduit 4.

As a result, displacing the flow channel area changing part 24 according to the change of the intake air negative pressure in the intake air duct 2 can change the opening of the communicating conduit 4.

(5) Moreover, with the intake air noise adjuster 1 according to the first embodiment, the opening changer 25 includes the blocking plate 30 and the blocking plate biasing member 32. The blocking plate 30 blocks the negative pressure introducing chamber 28 is connected to the flow channel area changing part 24. Meanwhile, the blocking plate biasing member 32 pushes and biases the blocking plate 30 to displace the flow channel area changing part 24 in the direction of increasing the opening of the communicating conduit 4 when the intake air negative pressure is less than the certain pressure.

As such, the spring constant of the blocking plate biasing member 32 can be set according to i) the relaxed acceleration or idling period for relieving the effect of increasing the intake air noise and ii) the rapid acceleration period for increasing the intake air noise.

As a result, i) the relaxed acceleration for relieving the effect of increasing the intake air noise and ii) the rapid acceleration for increasing the intake air noise can be distinctly set per vehicle according to the driver's gusto or preference, in other words, bringing about various and flexible functions.

(6) Moreover, with the intake air noise adjuster 1 according to the first embodiment, the flow channel area changing part 24 which is an elliptical plate member is so formed as to correspond to the cross section of the communicating conduit 4. Moreover, the flow channel area changing part 24 is supported to the communicating conduit 4 in such a configuration as to displaceably rotate around the axis P intersecting with the lengthwise direction 4D of the communicating conduit 4.

As a result, in the communicating conduit 4, rotating the flow channel area changing part 24 around the axis P intersecting with the lengthwise direction 4D of the communicating conduit 4 can change the flow channel area of the communicating conduit 4.

(7) Moreover, with the intake air noise adjuster 1 according to the first embodiment, the communicating conduit 4 includes the first communicating part 4*a* communicating with the intake air passage 2 and the second communicating part 4*b* which is disposed more on the external air 70 side than the first communicating part 4*a* is disposed.

As a result, when the elastic body 6 is damaged or the like, replacing the elastic body 6 is easy. Moreover, distinguishing the first communicating part 4*a* from the second communicating part 4*b* in structure is easy.

(Modifications)

(1) The intake air noise adjuster 1 according to the first embodiment has the following structure:

On the outer face of the clean side intake air duct 14, the communicating conduit 4 is mounted in the position further away from the engine 10 than the position where the throttle chamber 18 is disposed.

The intake air noise adjuster 1 is, however, not limited to the above in structure. Specifically, on the outer face of the clean side intake air duct 14, the communicating conduit 4 may be mounted in a position closer to the engine 10 than the position where the throttle chamber 18 is mounted.

(2) Moreover, with the intake air noise adjuster 1 according to the first embodiment, the negative pressure introducing chamber 28 includes the introducing conduit 34 and the cylindrical part 36, but not limited thereto. Specifically, the negative pressure introducing chamber 28 may be formed into, for example, a single cylindrical member. In this case, the blocking plate biasing member 32 is fixed to the inside of the negative pressure introducing chamber 28 by means of, for example, welding, adhesion and the like.

(3) Moreover, with the intake air noise adjuster 1 according to the first embodiment, the blocking plate 30 is connected to the flow channel area changing part 24 by way of the connector 38, but not limited thereto. Specifically, the blocking plate 30 may be directly connected (i.e., without the connector 38) to the flow channel area changing part 24 when, for example, the outer periphery of the communicating conduit 4 has a slit and the flow channel area changing part 24 is disposed in the communicating conduit 4 by passing the flow channel area changing part 24 from the external part through the slit.

(4) Moreover, with the intake air noise adjuster 1 according to the first embodiment, the elastic body 6 is sandwiched between the first communicating part 4*a* and the second communicating part 4*b*, but not limited thereto. Specifically, the communicating conduit 4 may have such a structure that the conduit is a single cylindrical member and the elastic body 6 is mounted by means of an adhesive and the like to the inner periphery of the communicating conduit 4 for blocking the communicating conduit 4. In the above structure, additional conduits sandwiching therebetween the elastic body 6 may be connected to the communicating conduit 4. Moreover, the communicating conduit 4 and the additional conduit in combination may have such a structure that the first resonant frequency caused by the communicating conduit 4 and elastic body 6 is resonant with the second resonant frequency caused by the additional conduits and body 6.

(5) Moreover, with the intake air noise adjuster 1 according to the first embodiment, it is the engine 10 serving as the pressure source for causing the pressure fluctuation to the gas present in the intake air duct 2, but not limited to the engine 10. Specifically, a pump, for example, can replace the engine 10. The intake air noise adjuster 1 according to the first embodiment is applicable to whatever includes an air vent conduit communicating with a pressure source for causing a pressure fluctuation to the gas and causes the pressure fluctuation to the gas present in the air vent conduit.

(6) Moreover, with the intake air noise adjuster 1 according to the first embodiment, the introducing conduit 34 is formed of steel pipe but not limited thereto. Otherwise, the introducing conduit 34 may be formed of plastic members such as hose, tube and the like. In this case, it is preferable that the intake air noise adjuster 1 has a holder for holding the cylindrical part 36's position relative to the communicating conduit 4.

(7) Moreover, with the intake air noise adjuster 1 according to the first embodiment, the first communicating part 4*a* and the second communicating part 4*b* are the same in inner diameter, but not limited thereto. For example, the second communicating part 4*b* may be larger in cross section than the first communicating part 4*a*.

(8) Moreover, with the intake air noise adjuster 1 according to the first embodiment, the first communicating part 4*a* and the second communicating part 4*b* are the same in length, but not limited thereto. For example, the first communicating part 4*a* may be different in length from the second communicating part 4*b*.

Second Embodiment (Structure)

Next, a second embodiment of the present invention is to be set forth.

Figure 4:
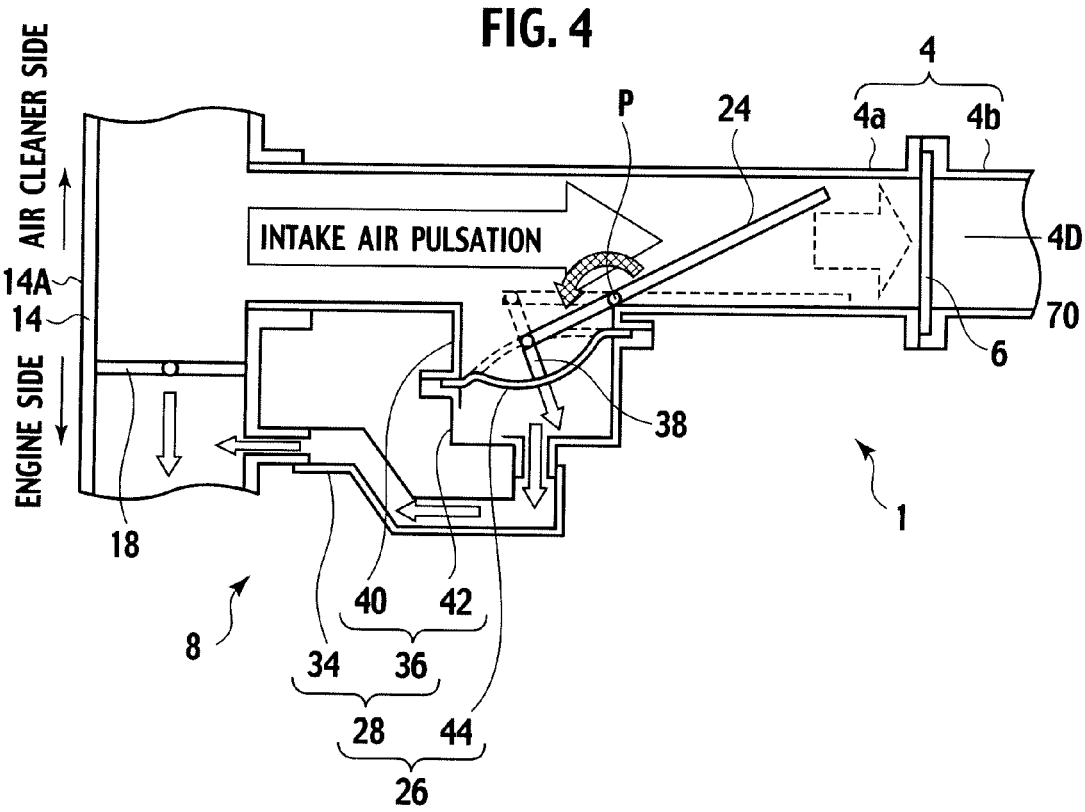
FIG. 4 shows a state of the flow channel area changer during the idling or relaxed acceleration period, according to a second embodiment of the present invention.
Figure 5:
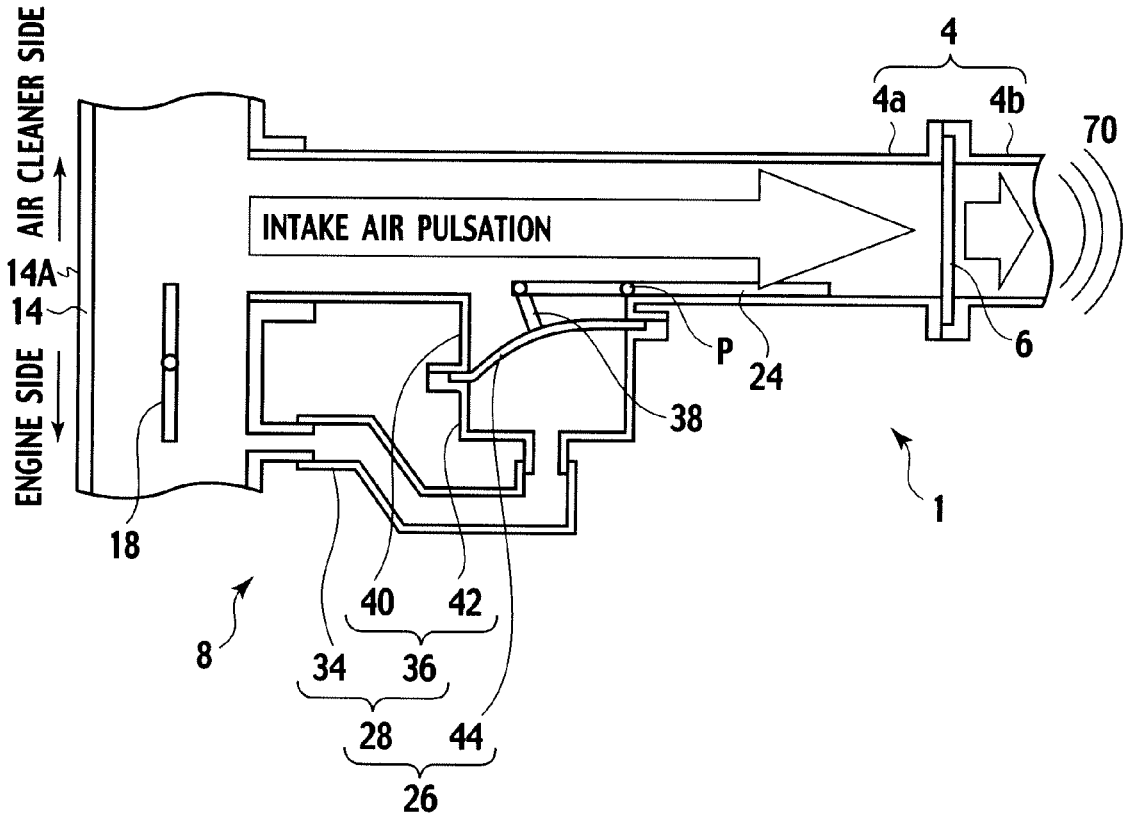
FIG. 5 shows a state of the flow channel area changer during the rapid acceleration period, according to the second embodiment of the present invention.

FIG. 4 and FIG. 5 each show a structure of the intake air noise adjuster 1, according to the second embodiment of the present invention.

FIG. 4 shows a state of the flow channel area changer 8 during the relaxed acceleration or idling period, while FIG. 5 shows a state of the flow channel area changer 8 during the rapid acceleration period.

As shown in FIG. 4 and FIG. 5, the structure of the intake air noise adjuster 1 according to the second embodiment is substantially the same as that of the intake air noise adjuster 1 according to the first embodiment, other than the structure of the flow channel area changer 8. Therefore, detailed explanations of the structure of the members other than the flow channel area changer 8 are to be omitted.

The flow channel area changer 8 includes the flow channel area changing part 24 and the displacer 26.

The flow channel area changing part 24 is formed of an elliptical plate member which is so shaped as to correspond to the cross section of the communicating conduit 4. In the communicating conduit 4, the flow channel area changing part 24 is disposed more on the clean side intake air duct 14 side than the elastic body 6 is disposed.

Moreover, on the communicating conduit 4's inner periphery on the negative pressure introducing chamber 28 side, the flow channel area changing part 24 is supported to the communicating conduit 4 in such a configuration as to displaceably rotate around an axis P intersecting with the lengthwise direction 4D of the communicating conduit 4. In FIG. 4 and FIG. 5, the flow channel area changing part 24's rotary center with respect to the communicating conduit 4 is denoted by "P."

Rotating and thereby displacing the flow channel area changing part 24 in the communicating conduit 4 changes the flow channel area.

Specifically, rotating and thereby displacing the flow channel area changing part 24 in the communicating conduit 4 inclines the longitudinal direction of the flow channel area changing part 24 relative to the lengthwise direction 4D of the communicating conduit 4. In this operation, the increased inclination decreases the opening of the communicating conduit 4, thus decreasing the flow channel area smaller than the maximum. Moreover, like FIG. 2, FIG. 4 shows a semicircular arrow for denoting a direction of displacing the flow channel area changing part 24.

Increasing the inclination (the longitudinal direction of the flow channel area changing part 24 relative to the lengthwise direction 4D of the communicating conduit 4) to such an extent that the flow channel area changing part 24's end on the elastic body 6 side contacts the inner periphery of the communicating conduit 4, as shown in FIG. 4, minimizes the opening of the communicating conduit 4, thereby blocking the clean side intake air duct 14 from the elastic body 6. In this state, the flow channel area is minimized. Like FIG. 2, FIG. 4 shows a state that the throttle chamber 18 is closed.

Moreover, rotating and thereby displacing the flow channel area changing part 24 in the communicating conduit 4 increases the opening of the communicating conduit 4, in the process from a first state (the longitudinal direction of the flow channel area changing part 24 is inclined relative to the lengthwise direction 4D of the communicating conduit 4) to a second state (the longitudinal direction of the flow channel area changing part 24 is substantially parallel to the lengthwise direction 4D of the communicating conduit 4), to thereby lead the flow channel area more and more to the maximum.

Then, as shown in FIG. 5, the longitudinal direction of the flow channel area changing part 24 becoming parallel to the lengthwise direction 4D of the communicating conduit 4 allows the flow channel area changing part 24's face on the negative pressure introducing chamber 28 side to contact the communicating conduit 4's inner periphery on the negative pressure introducing chamber 28 side. In this state, the opening of the communicating conduit 4 is maximized, thus maximizing the flow channel area. Like FIG. 3, FIG. 5 shows a state that the opening of the throttle chamber 18 is maximized.

The displacer 26 includes the negative pressure introducing chamber 28 and an elastic film part 44 (otherwise referred to as "opening changer 44").

The negative pressure introducing chamber 28 includes the introducing conduit 34 and the cylindrical part 36.

The introducing conduit 34 is formed of, for example, a steel pipe which is shaped substantially into a cylinder.

The introducing conduit 34 has the first end which is mounted to the outer periphery 14A of the clean side intake air duct 14, specifically, mounted in the position closer to the engine 10 than a position where the throttle chamber 18 is mounted. As such, the introducing conduit 34 communicates with the clean side intake air duct 14. The second end of the introducing conduit 34 communicates with the cylindrical part 36.

The cylindrical part 36 includes i) a first cylindrical part 40 on the communicating conduit 4 side and ii) a second cylindrical part 42 which is disposed further away from the communicating conduit 4 than the first cylindrical part 40 is disposed.

Each of the first cylindrical part 40 and second cylindrical part 42 is formed of a steel pipe and shaped into a cylinder which is larger in diameter than the introducing conduit 34. An axis of each of the first cylindrical part 40 and second cylindrical part 42 is substantially parallel to the lengthwise direction of the clean side intake air duct 14.

On the outer periphery of the communicating conduit 4, a first end of the first cylindrical part 40 is mounted more on the clean side intake air duct 14 side than the elastic body 6 is mounted. As such, the first cylindrical part 40 communicates with the communicating conduit 4. A second end of the first cylindrical part 40 communicates with a first end of the second cylindrical part 42.

A second end of the second cylindrical part 42 communicates with a second end of the introducing conduit 34. As such, the introducing conduit 34 communicates with the cylindrical part 36.

The elastic film part 44 is a circular plate member made of an elastic resinous material such as rubber and the like. Change of the engine side intake air negative pressure elastically deforms the elastic film part 44 facially outwardly. Like FIG. 2, FIG. 4 shows blank arrows denoting flow of the engine side intake air negative pressure.

Moreover, the elastic film part 44 is mounted to an inner periphery of the cylindrical part 36 in such a configuration that an outer periphery of the elastic film part 44 is interposed between the first cylindrical part 40 and the second cylindrical part 42, thus blocking the negative pressure introducing chamber 28, specifically, blocking the cylindrical part 36.

Moreover, the elastic film part 44 is connected to the flow channel area changing part 24 by way of the connector 38 shaped into a rod.

The connector 38 has a first end mounted substantially perpendicularly to the flow channel area changing part 24 and a second end mounted to the elastic film part 44's face on the communicating conduit 4 side.

The elastic film part 44 has such an elasticity that the elastic film part 44 is elastically deformed to the second cylindrical part 42 side when the engine side intake air negative pressure is more than or equal to the certain pressure.

Elastically deforming the elastic film part 44 to the second cylindrical part 42 side rotates and thereby displaces the flow channel area changing part 24 such that the flow channel area is decreased from the maximum. In this case, as shown in FIG. 4, the elasticity of the elastic film part 44 is so set that the flow channel area changing part 24 rotates and thereby displaces in the communicating conduit 4 such that the flow channel area changing part 24 contacts the inner periphery of the communicating conduit 4. In other words, the elasticity of the elastic film part 44 is so set that the elastic film part 44 is elastically deformed to the second cylindrical part 42 side to such an extent as to block the clean side intake air duct 14 from the elastic body 6.

Meanwhile, the elasticity of the elastic film part 44 is so set that the elastic film part 44 is elastically deformed to the communicating conduit 4 side when the engine side intake air negative pressure is less than the certain pressure. In this case, as shown in FIG. 5, the elasticity of the elastic film part 44 is so set that the flow channel area changing part 24 rotates in the communicating conduit 4 and thereby the flow channel area changing part 24's face on the negative pressure introducing chamber 28 side contacts the communicating conduit 4's inner periphery on the negative pressure introducing chamber 28 side. In other words, the elasticity of the elastic film part 44 is so set that the elastic film part 44 is elastically deformed until the flow channel area is maximized.

As shown in FIG. 5, the elastic film part 44 elastically deformed to the communicating conduit 4 side rotates and thereby displaces the flow channel area changing part 24 such that the flow channel area is maximized.

Other components according to the second embodiment are substantially the same in structure as those according to the first embodiment.

(Operation)

Then, operations of the intake air noise adjuster 1 according to the second embodiment are to be set forth. In the following description according to the second embodiment, the structural components other than the flow channel area changer 8 are substantially the same as those according to the first embodiment. Therefore, set forth hereinafter are mainly about the operations of the different components.

After the engine 10 is driven, the intake air pulsation caused according to the intake air operation by the engine 10 is propagated, via the intake manifold 22 and surge tank 20, to the gas present in the clean side intake air duct 14 (see FIG. 1).

Herein, during the idling or relaxed acceleration period, the engine side intake air negative pressure is more than or equal to the certain pressure since the opening of the throttle chamber 18 is small. As such, the pressure in the negative pressure introducing chamber 28 becomes negative, thereby elastically deforming the elastic film part 44 to the second cylindrical part 42 side (see FIG. 4).

With the elastic film part 44 elastically deformed to the second cylindrical part 42 side, the flow channel area changing part 24 rotates around the axis intersecting with the lengthwise direction 4D of the communicating conduit 4 such that the flow channel area is decreased from the maximum (see FIG. 4).

The flow channel area changing part 24's rotation around the axis intersecting with the lengthwise direction 4D of the communicating conduit 4 rotates and thereby displaces the flow channel area changing part 24 in the communicating conduit 4, thus decreasing the flow channel area from the maximum (see FIG. 4).

In the above operation, the flow channel area changing part 24's end on the elastic body 6 side contacting the inner periphery of the communicating conduit 4 blocks the clean side intake air duct 14 from the elastic body 6, thus minimizing the flow channel area (see FIG. 4).

As such, the intake air pulsation caused according to the intake air operation by the engine 10 and propagated to the gas present in the clean side intake air duct 14 is suppressed from propagating to the elastic body 6, to thereby suppress vibration of the elastic body 6 (see FIG. 4).

Therefore, during the idling or relaxed acceleration period, the flow channel area is decreased from the maximum and the intake air pulsation propagated to the gas present in the clean side intake air duct 14 is suppressed from propagating to the elastic body 6, to thereby suppress vibration of the elastic body 6. Thereby, the effect of increasing the intake air noise can be relieved (see FIG. 4).

Moreover, during the idling or relaxed acceleration period, blocking the clean side intake air duct 14 from the elastic body 6 minimizes the flow channel area, thus greatly relieving the effect of increasing the intake air noise. As such, the intake air noise introduced into the vehicle compartment is rendered slight (see FIG. 4).

Meanwhile, during the rapid acceleration period, the opening of the throttle chamber 18 is large. As such, the engine side intake air negative pressure is rendered less than the certain pressure, making the following operations (see FIG. 5):

1) rendering the pressure in the negative pressure introducing chamber 28 from negative to positive, and 2) elastically deforming the elastic film part 44 to the communicating conduit 4 side.

Elastically deforming the elastic film part 44 to the communicating conduit 4 side rotates the flow channel area changing part 24 around the axis intersecting with the lengthwise direction 4D of the communicating conduit 4, thereby communicating the clean side intake air duct 14 with the elastic body 6 (see FIG. 5).

Then, the longitudinal direction of the flow channel area changing part 24 becoming parallel to the lengthwise direction 4D of the communicating conduit 4 allows the flow channel area changing part 24's face on the negative pressure introducing chamber 28 side to contact the communicating conduit 4's inner periphery on the negative pressure introducing chamber 28 side, thus maximizing the flow channel area (see FIG. 5).

As such, the intake air pulsation caused according to the intake air operation by the engine 10 and propagated to the gas present in the clean side intake air duct 14 is propagated to the elastic body 6, thus vibrating the elastic body 6 facially outwardly. Then, the increased intake air noise is radiated outwardly to the external air 70 from the second open end of the communicating conduit 4 (see FIG. 1).

Therefore, during the rapid acceleration period, the flow channel area is maximized and the intake air pulsation propagated to the elastic body 6 vibrates the elastic body 6 facially outwardly, thus increasing the intake air noise which contributes to a production of the acceleration feeling (see FIG. 5).

(Effect of Second Embodiment)

(1) With the intake air noise adjuster 1 according to the second embodiment, the displacer 26 includes the negative pressure introducing chamber 28 and the elastic film part 44, where the elastic film part 44 blocks the negative pressure introducing chamber 28 and is connected to the flow channel area changing part 24 and where change of the engine side intake air negative pressure elastically deforms the elastic film part 44 to thereby displace the flow channel area changing part 24.

As such, the intake air noise adjuster 1 according to the second embodiment simpler in structure than the intake air noise adjuster 1 according to the first embodiment can bring about the following effect:

1) during the relaxed acceleration or idling period for securing silence, relieving the effect of increasing the intake air noise, and 2) during the rapid acceleration period by the driver's strong intention of acceleration, radiating the increased intake air noise outwardly to the external air 70 from the second open end of the communicating conduit 4.

As a result, with the intake air noise adjuster 1 according to the second embodiment, i) securing the silence during the relaxed acceleration or idling period and ii) increasing the intake air noise during the rapid acceleration period each can be accomplished by the structure simpler than that of the intake air noise adjuster 1 according to the first embodiment.

(2) With the intake air noise adjuster 1 according to the second embodiment; on the outer periphery of the communicating conduit 4, the first end of the first cylindrical part 40 is mounted more on the clean side intake air duct 14 side than the elastic body 6 is mounted, thus communicating the first cylindrical part 40 with the communicating conduit 4.

As a result, a simple structure can secure an airtightness of a space formed by the communicating conduit 4's outer periphery, the first cylindrical part 40 and the elastic film part 44, and the elastic film part 44's elastic deformation by the engine side intake air negative pressure can be secured.

(Modifications)

(1) With the intake air noise adjuster 1 according to the second embodiment, it is so configured that the first end of the first cylindrical part 40 is mounted to the outer periphery of the communicating conduit 4 for communicating the first cylindrical part 40 with the communicating conduit 4, but not limited thereto. Specifically, blocking the first end of the first cylindrical part 40 and thereby no communication between the first cylindrical part 40 and the communicating conduit 4 is allowed. In this case, for example, an opening for allowing the connector 38 to pass therethrough is formed on the outer periphery of the communicating conduit 4 and a measure for securing an airtightness between the opening's wall and the connector 38 is provided.

(2) Moreover, with the intake air noise adjuster 1 according to the second embodiment, the elastic film part 44 is interposed between the first cylindrical part 40 and the second cylindrical part 42, but limited thereto. Specifically, such a structure is allowed that the elastic film part 44 is formed of a single cylindrical member and the elastic body 6 is mounted to the inner periphery of the elastic film part 44 for blocking the cylindrical part 36.

Third Embodiment (Structure)

Next, a third embodiment of the present invention is to be set forth.

Figure 6:
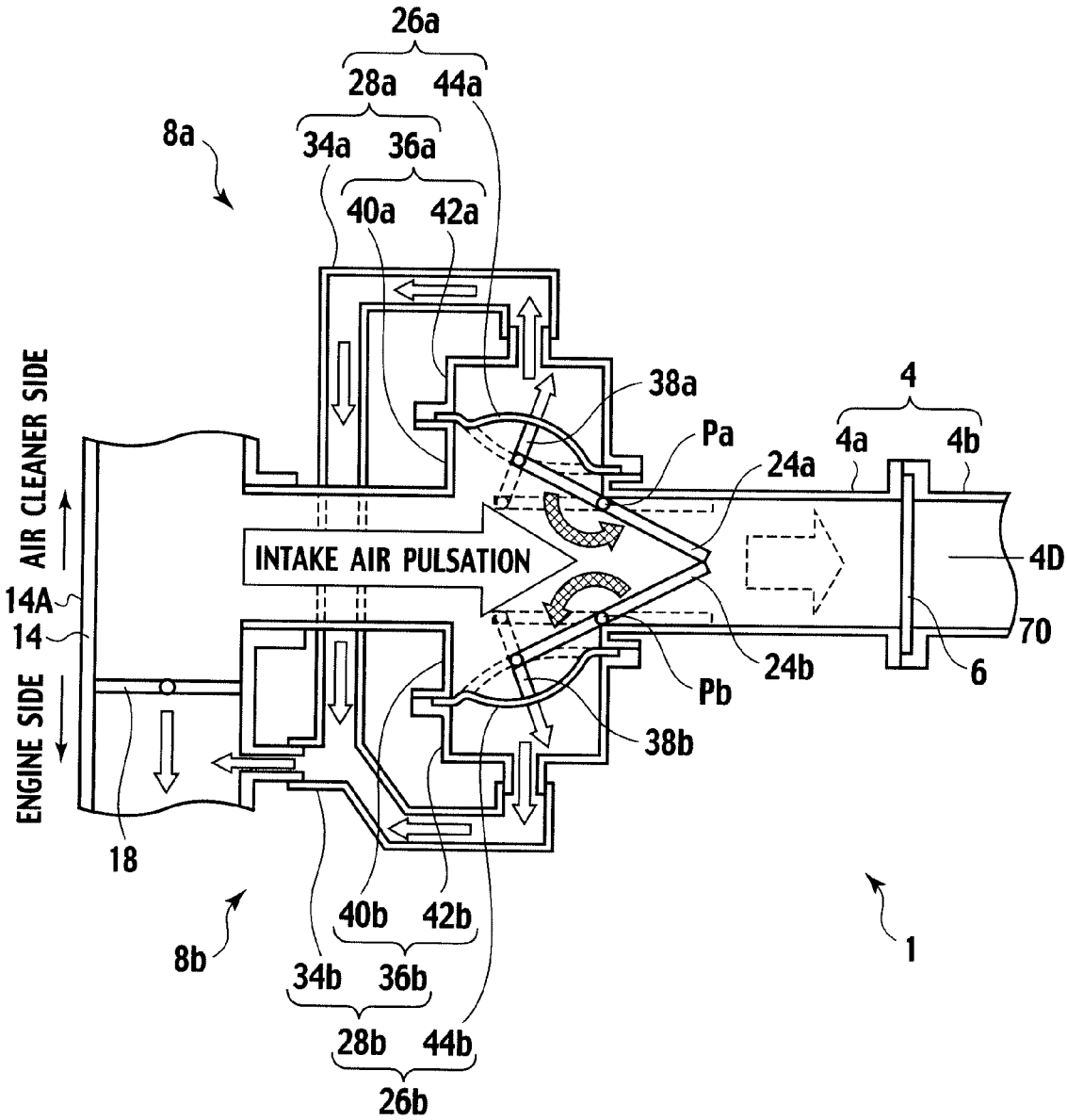
FIG. 6 shows a state of the flow channel area changer during the idling or relaxed acceleration period, according to a third embodiment of the present invention.
Figure 7:
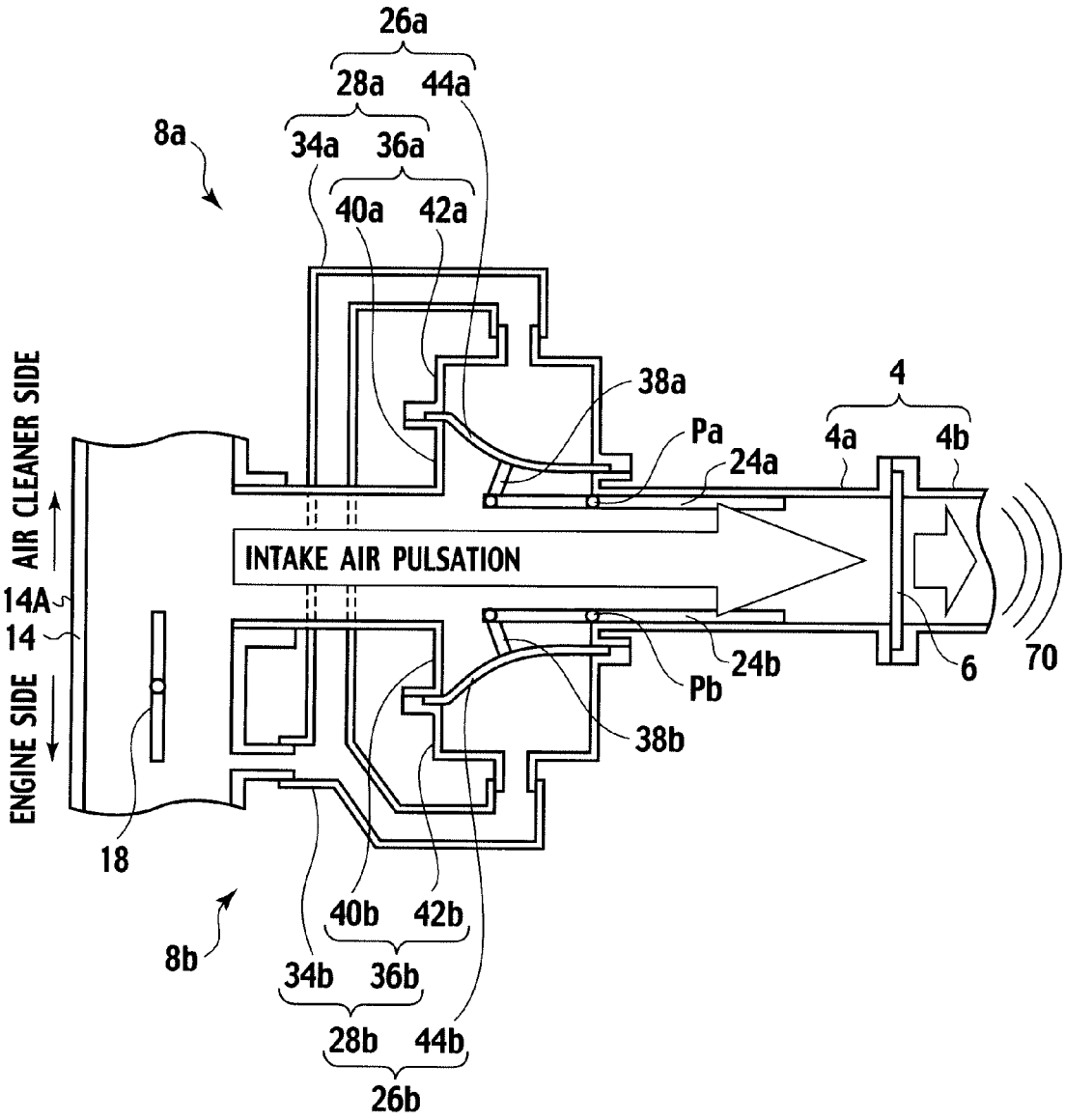
FIG. 7 shows a state of the flow channel area changer during the rapid acceleration period, according to the third embodiment of the present invention.

FIG. 6 and FIG. 7 each show a structure of the intake air noise adjuster 1, according to the third embodiment of the present invention. FIG. 6 shows a state of the flow channel area changer 8 during the relaxed acceleration or idling period while FIG. 7 shows a state of the flow channel area changer 8 during the rapid acceleration period.

As shown in FIG. 6 and FIG. 7, the structure of the intake air noise adjuster 1 according to the third embodiment is substantially the same as that of the intake air noise adjuster 1 according to the first embodiment, other than the structure of the flow channel area changer 8. Therefore, detailed explanations of the structure of the members other than the flow channel area changer 8 are to be omitted.

The intake air noise adjuster 1 of the third embodiment includes two flow channel area changers, i.e., flow channel area changers 8*a*, 8*b*. In FIG. 6, FIG. 7 and the description hereinafter, the flow channel area changer 8 disposed on the air cleaner 16 side is defined as "flow channel area changer 8*a*" while the flow channel area changer 8 disposed on the engine 10 side is defined as "flow channel area changer 8*b*."

The flow channel area changers 8*a*, 8*b* respectively include flow channel area changing parts 24*a*, 24*b* and displacers 26*a*, 26*b*. In FIG. 6, FIG. 7 and the description hereinafter, the flow channel area changing part 24 and displacer 26 of the flow channel area changer 8*a* are defined respectively as "changing part 24*a* and displacer 26*a*" while the flow channel area changing part 24 and displacer 26 of the flow channel area changer 8*b* are defined respectively as "changing part 24*b* and displacer 26*b*."

In the communicating conduit 4, the flow channel area changing parts 24*a*, 24*b* are each disposed more on the clean side intake air duct 14 side than the elastic body 6 is disposed and are opposed to each other intervening therebetween the center axis of the communicating conduit 4.

Moreover, each of the flow channel area changing parts 24*a*, 24*b* is formed of a semicircular plate. It is so configured that ends of the flow channel area changing parts 24*a*, 24*b*, when contacting each other, block the communicating conduit 4.

Moreover, on the communicating conduit 4's inner peripheries on negative pressure introducing chambers 28*a*, 28*b* (to be described afterward) sides, the flow channel area changing parts 24*a*, 24*b* are supported to the communicating conduit 4 in such a configuration as to displaceably rotate around the axis P intersecting with the lengthwise direction 4D of the communicating conduit 4. In FIG. 6 and FIG. 7, the flow channel area changing parts 24*a*, 24*b*'s rotary centers with respect to the communicating conduit 4 are respectively denoted by "Pa" and "Pb."

Rotating and thereby displacing the flow channel area changing parts 24*a*, 24*b* in the communicating conduit 4 changes the flow channel area. Moreover, like FIG. 2, FIG. 4 shows semicircular arrows for denoting directions for displacing the flow channel area changing parts 24*a*, 24*b*.

Specifically, rotating and thereby displacing the flow channel area changing parts 24*a*, 24*b* in the communicating conduit 4 inclines the longitudinal direction of each of the flow channel area changing parts 24*a*, 24*b*, relative to the lengthwise direction 4D of the communicating conduit 4. Increasing the inclination decreases the opening of the communicating conduit 4, thereby deceasing the flow channel area smaller than the maximum.

Increasing the inclination (the longitudinal direction of each of the flow channel area changing parts 24*a*, 24*b*, relative to the lengthwise direction 4D of the communicating conduit 4) to such an extent that the flow channel area changing parts 24*a*, 24*b*'s ends on the elastic body 6 side contact each other, as shown in FIG. 6, minimizes the opening of the communicating conduit 4, thereby blocking the clean side intake air duct 14 from the elastic body 6. In this state, the flow channel area is minimized. Like FIG. 2, FIG. 6 shows a state that the throttle chamber 18 is closed.

Then, rotating and thereby displacing the flow channel area changing parts 24*a*, 24*b* in the communicating conduit 4 to such an extent that the longitudinal direction of each of the flow channel area changing parts 24*a*, 24*b* becomes parallel to the lengthwise direction 4D of the communicating conduit 4 from the above inclination increases the opening of the communicating conduit 4, thereby allowing the flow channel area to come closer to the maximum.

Then, as shown in FIG. 7, the longitudinal direction of each of the flow channel area changing parts 24*a*, 24*b* becoming substantially parallel to the lengthwise direction 4D of the communicating conduit 4 allows the respective flow channel area changing parts 24*a*, 24*b*'s faces on the negative pressure introducing chamber 28 side to contact the communicating conduit 4's inner peripheries on the negative pressure introducing chamber 28 side. In this state, the opening of the communicating conduit 4 is maximized, thus maximizing the flow channel area. Like FIG. 3, FIG. 7 shows a state that the throttle chamber 18 has the maximum opening.

The displacers 26*a*, 26*b* respectively include negative pressure introducing chambers 28*a*, 28*b* and elastic film parts 44*a*, 44*b* (otherwise referred to as "opening changers 44*a*, 44*b*"). In FIG. 6, FIG. 7 and the description hereinafter, the negative pressure introducing chamber 28 and elastic film part 44 of the displacer 26*a* are respectively defined as "negative pressure introducing chamber 28*a*" and "elastic film part 44*a*" while the negative pressure introducing chamber 28 and elastic film part 44 of the displacer 26*b* are respectively defined as "negative pressure introducing chamber 28*b*" and "elastic film part 44*b*."

The negative pressure introducing chambers 28*a*, 28*b* respectively include introducing conduits 34*a*, 34*b* and cylindrical parts 36*a*, 36*b*. In FIG. 6, FIG. 7 and the description hereinafter, the introducing conduit 34 and cylindrical part 36 of the negative pressure introducing chamber 28*a* are respectively defined as "introducing conduit 34*a*" and "cylindrical part 36*a*" while the introducing conduit 34 and cylindrical part 36 of the negative pressure introducing chamber 28*b* are respectively defined as "introducing conduit 34*b*" and "cylindrical part 36*b*."

The introducing conduit 34*a* is formed of, for example, a steel pipe which is shaped substantially into a cylinder.

The introducing conduit 34*a* has a first end, which is mounted to the outer periphery 14A of the clean side intake air duct 14, specifically, mounted in a position closer to the engine 10 than a position where the throttle chamber 18 is mounted. As such, the introducing conduit 34*a* communicates with the clean side intake air duct 14. A second end of the introducing conduit 34*a* communicates with the cylindrical part 36*a*.

The cylindrical part 36*a* includes i) a first cylindrical part 40*a* on the communicating conduit 4 side and ii) a second cylindrical part 42*a* which is disposed further away from the communicating conduit 4 than the first cylindrical part 40*a* is disposed.

Each of the first and second cylindrical parts 40*a*, 42*a* is formed of a steel pipe and shaped into a cylinder which is larger in diameter than the introducing conduit 34*a*. An axis of each of the first and second cylindrical parts 40*a*, 42*a* is substantially parallel to the lengthwise direction of the clean side intake air duct 14.

On the outer periphery of the communicating conduit 4, a first end of the first cylindrical part 40*a* is mounted more on the clean side intake air duct 14 side than the elastic body 6 is mounted. As such, the first cylindrical part 40*a* communicates with the communicating conduit 4. A second end of the first cylindrical part 40*a* communicates with a first end of the second cylindrical part 42*a*.

A second end of the second cylindrical part 42*a* communicates with a second end of the introducing conduit 34*a*. As such, the introducing conduit 34*a* communicates with the cylindrical part 36*a*.

Like the introducing conduit 34*a*, the introducing conduit 34*b* is formed of, for example, a steel pipe which is shaped substantially into a cylinder.

The introducing conduit 34*b* has a first end which is mounted to an outer periphery of the introducing conduit 34*a*, specifically, mounted in a position closer to between the clean side intake air duct 14 and the second cylindrical part 42*a*. As such, the introducing conduit 34*b* communicates with the introducing conduit 34*a*. A second end of the introducing conduit 34*b* communicates with the cylindrical part 36*b*.

The cylindrical part 36*b* is disposed more on the clean side intake air duct 14 side than the communicating conduit 4 is disposed. Moreover, the cylindrical part 36*b* is opposed to the cylindrical part 36*a* interposing therebetween the center axis of the communicating conduit 4.

Moreover, the cylindrical part 36*b* includes i) a first cylindrical part 40*b* on the communicating conduit 4 side and ii) a second cylindrical part 42*b* which is disposed further away from the communicating conduit 4 than the first cylindrical part 40*a* is disposed.

Each of the first and second cylindrical parts 40*b*, 42*b* is formed of a steel pipe and shaped into a cylinder which is larger in diameter than the introducing conduit 34*b*. An axis of each of the first and second cylindrical parts 40*b*, 42*b* is substantially parallel to the lengthwise direction of the clean side intake air duct 14.

On the outer periphery of the communicating conduit 4, a first end of the first cylindrical part 40*b* is mounted more on the clean side intake air duct 14 side than the elastic body 6 is mounted. As such, the first cylindrical part 40*b* communicates with the communicating conduit 4. A second end of the first cylindrical part 40*b* communicates with a first end of the second cylindrical part 42*b*.

A second end of the second cylindrical part 42*b* communicates with a second end of the introducing conduit 34*b*. As such, the introducing conduit 34*b* communicates with the cylindrical part 36*b*.

Each of the elastic film parts 44*a*, 44*b* is a circular plate member made of an elastic resinous material such as rubber and the like. Change of the engine side intake air negative pressure elastically deforms the elastic film parts 44*a*, 44*b* facially outwardly. Like FIG. 2, FIG. 6 shows blank arrows denoting flow of the engine side intake air negative pressure.

Moreover, the elastic film parts 44*a*, 44*b* are mounted to inner peripheries of the cylindrical parts 36*a*, 36*b* such that outer peripheries of the respective elastic film parts 44*a*, 44*b* are interposed between the first cylindrical parts 40*a*, 40*b* and the second cylindrical parts 42*a*, 42*b*, thus blocking the negative pressure introducing chambers 28*a*, 28*b*, specifically, blocking the cylindrical parts 36*a*, 36*b*.

Moreover, the elastic film parts 44*a*, 44*b* are respectively connected to the flow channel area changing parts 24*a*, 24*b* by way of the connectors 38*a*, 38*b* each shaped into a rod.

The connectors 38*a*, 38*b* have first ends substantially perpendicularly mounted to the respective flow channel area changing parts 24*a*, 24*b* and second ends mounted to the respective elastic film parts 44*a*, 44*b*'s faces on the communicating conduit 4 side.

The elastic film parts 44*a*, 44*b* each have such an elasticity that the elastic film parts 44*a*, 44*b* are elastically deformed to the second cylindrical parts 42*a*, 42*b* sides when the engine side intake air negative pressure is more than or equal to the certain pressure.

Elastically deforming the elastic film parts 44*a*, 44*b* to the respective second cylindrical parts 42*a*, 42*b* sides rotates and thereby displaces the flow channel area changing parts 24*a*, 24*b* such that the flow channel area is decreased from the maximum. In this case, as shown in FIG. 6, the elasticity of the elastic film parts 44*a*, 44*b* is so set that the flow channel area changing parts 24*a*, 24*b* rotate and thereby displace in the communicating conduit 4 such that the flow channel area changing parts 24*a*, 24*b*'s ends on the elastic body 6 side contact with each other. In other words, the elasticity of the elastic film parts 44*a*, 44*b* is so set that the elastic film parts 44*a*, 44*b* are elastically deformed to the second cylindrical parts 42*a*, 42*b* sides to such an extent as to block the clean side intake air duct 14 from the elastic body 6.

Moreover, the elasticity of the elastic film parts 44*a*, 44*b* is so set that the elastic film parts 44*a*, 44*b* are elastically deformed to the communicating conduit 4 side when the engine side intake air negative pressure is less than the certain pressure. In this case, as shown in FIG. 7, the elasticity of the elastic film part 44*a* is so set that the flow channel area changing part 24*a* rotates in the communicating conduit 4 and thereby the flow channel area changing part 24*a*'s face on the negative pressure introducing chamber 28*a* contacts the communicating conduit 4's inner periphery on the negative pressure introducing chamber 28*a* side. Likewise, as shown in FIG. 7, the elasticity of the elastic film part 44*b* is so set that the flow channel area changing part 24*b* rotates in the communicating conduit 4 and thereby the flow channel area changing part 24*b*'s face on the negative pressure introducing chamber 28*b* contacts the communicating conduit 4's inner periphery on the negative pressure introducing chamber 28*b* side. In sum, the elasticity of the elastic film parts 44*a*, 44*b* is so set that each of the elastic film parts 44*a*, 44*b* is elastically deformed to the communicating conduit 4 side until the flow channel area is maximized.

As shown in FIG. 7, the elastic film parts 44*a*, 44*b* elastically deformed to the communicating conduit 4 side respectively rotate and thereby displace the flow channel area changing parts 24*a*, 24*b* such that the flow channel area is maximized.

Other components according to the third embodiment are substantially the same in structure as those according to the first embodiment.

(Operation)

Then, operations of the intake air noise adjuster 1 according to the third embodiment are to be set forth. In the following description according to the third embodiment, the structural components other than the flow channel area changer 8 are substantially the same as those according to the first embodiment. Therefore, set forth hereinafter are mainly about the operations of the different components.

After the engine 10 is driven, the intake air pulsation caused according to the intake air operation by the engine 10 is propagated, via the intake manifold 22 and surge tank 20, to the gas present in the clean side intake air duct 14 (see FIG. 1).

Herein, during the idling or relaxed acceleration period, the engine side intake air negative pressure is more than or equal to the certain pressure since the opening of the throttle chamber 18 is small. As such, the pressure in the negative pressure introducing chamber 28 becomes negative, thereby elastically deforming the elastic film parts 44*a*, 44*b* to the second cylindrical parts 42*a*, 42*b* sides respectively (see FIG. 6).

With the elastic film parts 44*a*, 44*b* elastically deformed to the second cylindrical parts 42*a*, 42*b* sides respectively, the flow channel area changing parts 24*a*, 24*b* each rotate around the axis intersecting with the lengthwise direction 4D of the communicating conduit 4 such that the flow channel area is decreased from the maximum (see FIG. 6).

The above operation rotates and thereby displaces the flow channel area changing parts 24*a*, 24*b* in the communicating conduit 4, thus decreasing the flow channel area smaller than the maximum.

In the above operation, the flow channel area changing part 24*a*'s end on the elastic body 6 side contacting the flow channel area changing part 24*b*'s end on the elastic body 6 side blocks the clean side intake air duct 14 from the elastic body 6, thus minimizing the flow channel area (see FIG. 6).

As such, the intake air pulsation caused according to the intake air operation by the engine 10 and propagated to the gas present in the clean side intake air duct 14 is suppressed from propagating to the elastic body 6, to thereby suppress vibration of the elastic body 6 (see FIG. 6).

Therefore, during the idling or relaxed acceleration period, the flow channel area is decreased from the maximum and the intake air pulsation propagated to the gas present in the clean side intake air duct 14 is suppressed from propagating to the elastic body 6, to thereby suppress vibration of the elastic body 6. Thereby, the effect of increasing the intake air noise can be relieved (see FIG. 6).

Moreover, during the idling or relaxed acceleration period, blocking the clean side intake air duct 14 from the elastic body 6 minimizes the flow channel area, thus greatly relieving the effect of increasing the intake air noise. As such, the intake air noise introduced into the vehicle compartment is rendered slight (see FIG. 6).

Meanwhile, during the rapid acceleration period, the opening of the throttle chamber 18 is large. As such, the engine side intake air negative pressure is rendered less than the certain pressure, making the following operations (see FIG. 7):

1) rendering the pressure in the negative pressure introducing chamber 28 from negative to positive, and 2) elastically deforming the elastic film parts 44*a*, 44*b* to the communicating conduit 4 side.

Elastically deforming the elastic film parts 44*a*, 44*b* to the communicating conduit 4 side rotates the respective flow channel area changing parts 24*a*, 24*b* around the axis intersecting with the lengthwise direction 4D of the communicating conduit 4, thereby communicating the clean side intake air duct 14 with the elastic body 6 (see FIG. 7).

Then, the longitudinal direction of each of the flow channel area changing parts 24*a*, 24*b* becoming parallel to the lengthwise direction 4D of the communicating conduit 4 allows the flow channel area changing parts 24*a*, 24*b*s' faces on the respective negative pressure introducing chambers 28*a*, 28*b* sides to contact the communicating conduit 4's inner periphery on the respective negative pressure introducing chambers 28*a*, 28*b* sides, thus maximizing the flow channel area (see FIG. 7).

As such, the intake air pulsation caused according to the intake air operation by the engine 10 and propagated to the gas present in the clean side intake air duct 14 is propagated to the elastic body 6, thus vibrating the elastic body 6 facially outwardly. Then, the increased intake air noise is radiated outwardly to the external air 70 from the second open end of the communicating conduit 4 (see FIG. 1).

Therefore, during the rapid acceleration period, the flow channel area is maximized and the intake air pulsation propagated to the elastic body 6 vibrates the elastic body 6 facially outwardly, thus increasing the intake air noise which contributes to a production of the acceleration feeling (see FIG. 7).

(Effect of Third Embodiment)

(1) According to the third embodiment, the intake air noise adjuster 1 includes two flow channel area changers, that is, the flow channel area changing parts 24*a*, 24*b*. With the engine side intake air negative pressure more than or equal to the certain pressure, the above two flow channel area changing parts 24*a*, 24*b* block the clean side intake air duct 14 from the elastic body 6.

As such, the two flow channel area changers can block the clean side intake air duct 14 from the elastic body 6 more securely than the single flow area channel changer.

As a result, with the engine side intake air negative pressure more than or equal to the certain pressure, namely, during the relaxed acceleration or idling period for securing silence, the above two flow channel area changing parts 24*a*, 24*b* can securely relieve the effect of increasing the intake air noise, thus securing the silence.

(Modifications)

(1) The intake air noise adjuster 1 according to the third embodiment include two flow area channel changers, that is, the flow area channel changers 8*a*, 8*b*, but not limited thereto. Otherwise, three or more flow area channel changers are allowed. The essence is to provide a plurality of flow area channel changers 8.

(2) Moreover, one of the flow channel area changers 8*a* and 8*b* according to the third embodiment may be replaced with the flow channel area changer 8 including the opening changer 25 which has the blocking plate 30 and blocking plate biasing member 32 according to the first embodiment.

Fourth Embodiment (Structure)

Next, a fourth embodiment of the present invention is to be set forth.

Figure 8:
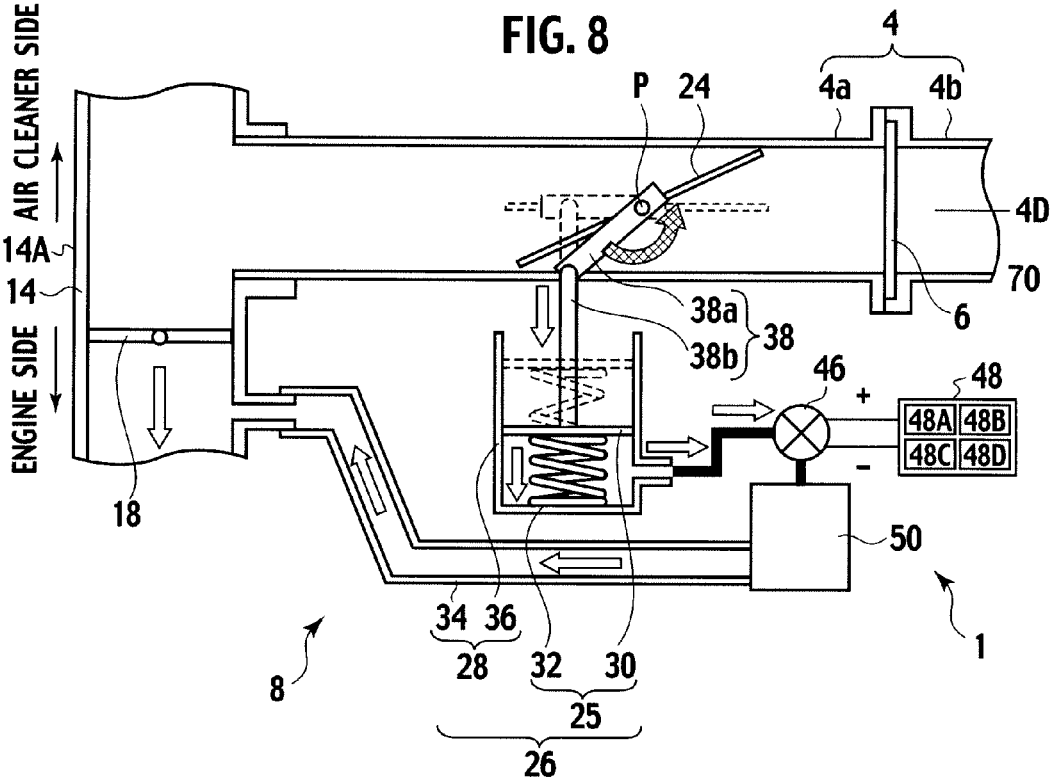
FIG. 8 shows a state of the flow channel area changer during the idling or relaxed acceleration period, according to a fourth embodiment of the present invention.
Figure 9:
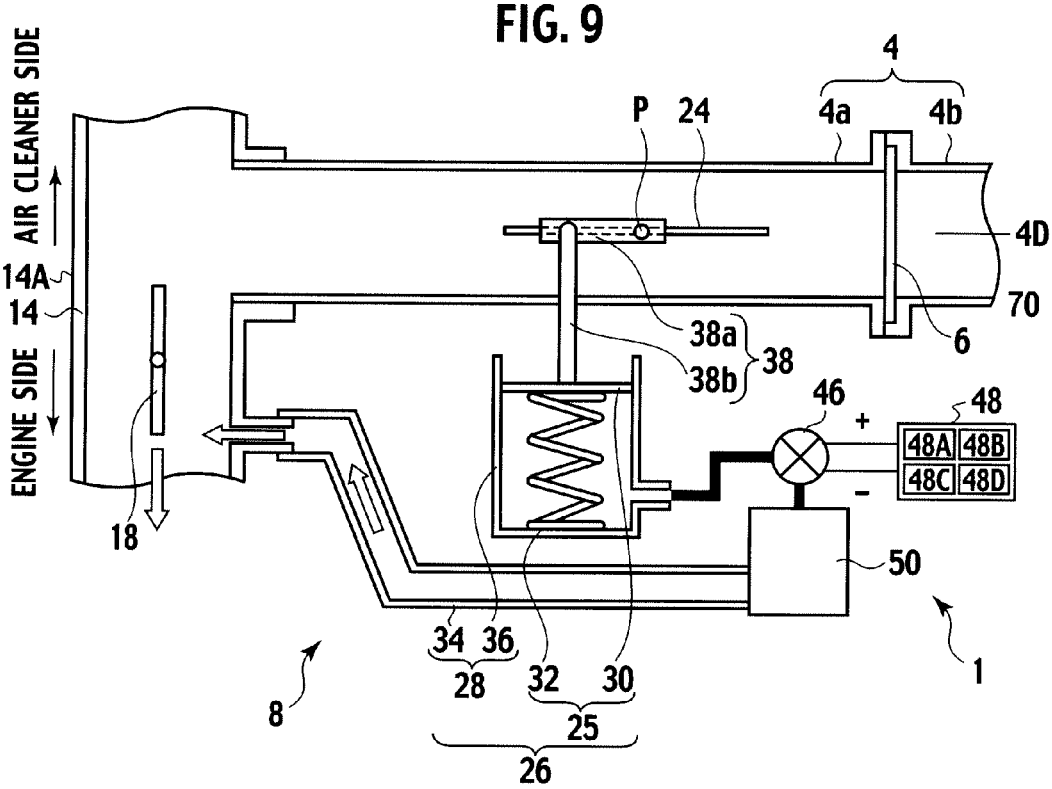
FIG. 9 shows a state of the flow channel area changer during the rapid acceleration period, according to the fourth embodiment of the present invention.

FIG. 8 and FIG. 9 each show a structure of the intake air noise adjuster 1, according to the fourth embodiment of the present invention. FIG. 8 shows a state of the flow channel area changer 8 during the relaxed acceleration or idling period while FIG. 9 shows a state of the flow channel area changer 8 during the rapid acceleration period.

As shown in FIG. 8 and FIG. 9, the structure of the intake air noise adjuster 1 according to the fourth embodiment is substantially the same as that of the intake air noise adjuster 1 according to the first embodiment, other than that the fourth embodiment has a gas movement controlling valve 46 and a controlling valve switching instructor 48 for controlling the gas movement controlling valve 46. Therefore, detailed explanations of the structure of the members other than the gas movement controlling valve 46, controlling valve switching instructor 48 and members related thereto are to be omitted.

The gas movement controlling valve 46 is, for example, an electronically controlled valve and disposed between the introducing conduit 34 and the cylindrical part 36. In other words, the gas movement controlling valve 46 is disposed between the clean side intake air duct 14 and the blocking plate 30. A negative pressure tank 50 for tanking therein a negative pressure caused in the clean side intake air duct 14 is disposed between the gas movement controlling valve 46 and the introducing conduit 34.

Then, after receiving a switching instruction signal transmitted from the controlling valve switching instructor 48, the gas movement controlling valve 46 switches an allowing state with a blocking state and vice versa according to the switching instruction signal.

The allowing state, as shown in FIG. 8, communicates the introducing conduit 34 with the cylindrical part 36, thus allowing communication between the clean side intake air duct 14 and the negative pressure introducing chamber 28. Moreover, like FIG. 2, FIG. 8 shows a semicircular arrow for denoting a direction of displacing the flow channel area changing part 24. Like FIG. 2, FIG. 8 shows a state that the throttle chamber 18 is closed.

In the allowing state for communicating the clean side intake air duct 14 with the negative pressure introducing chamber 28, the cylindrical part 36's space including the blocking plate biasing member 32 is rendered negative by means of the negative pressure tanked in the negative pressure tank 50. Like FIG. 2, FIG. 8 shows blank arrows denoting flow of the engine side intake air negative pressure.

Meanwhile, the blocking state, as shown in FIG. 9, blocks the introducing conduit 34 from the cylindrical part 36, thus blocking the clean side intake air duct 14 from the negative pressure introducing chamber 28. Moreover, like FIG. 3, FIG. 9 shows a state that the opening of the throttle chamber 18 is maximized.

In the blocking state for blocking the clean side intake air duct 14 from the negative pressure introducing chamber 28, the pressure of the cylindrical part 36's space including the blocking plate biasing member 32 is rendered from negative to positive.

The controlling valve switching instructor 48 is, for example, a known ECU (engine control unit) already installed to the vehicle and includes an engine speed information detector 48A, a switching condition determiner 48B and a switching instruction signal transmitter 48C, as shown in FIG. 8 and FIG. 9.

During the driving of the engine 10, the engine speed information detector 48A makes the following operations:

1) as an engine speed information signal, receiving information signals (including engine speed information) sensed by an engine speed information sensor 48D, and 2) then, transmitting the thus received engine speed information signal to the switching condition determiner 48B.

According to the fourth embodiment, the number of revolutions of the engine 10 is defined as the engine speed information.

After receiving the engine speed information signal, the switching condition determiner 48B makes the following operations:

based on the engine speed information, determining whether the gas movement controlling valve 46 should be rendered to the allowing state or the blocking state, and then, to the switching instruction signal transmitter 48C, transmitting the information signal (including the determination result) as a determination result signal.

Specifically, the switching condition determiner 48B makes the following operations:

1) memorizing a certain speed in advance, and 2) comparing i) the engine speed from the engine speed information detector 48A with ii) the certain speed.

Hereinabove, the "certain speed" is defined as en engine speed obtained in the following states which are not proper for increasing the intake air noise:

1) during the relaxed acceleration period when the driver's depressing of the accelerator pedal is small and the driver's intention of acceleration is weak, and 2) during the idling period when the driver is not depressing the accelerator pedal.

Then, when the engine speed is less than the certain speed, the switching condition determiner 48B makes the following operations:

1) determining to switch the gas movement controlling valve 46 to the allowing state, and 2) to the determination result signal, inputting information which has determined to switch the gas movement controlling valve 46 to the allowing state.

Meanwhile, when the engine speed is more than or equal to the certain speed, the switching condition determiner 48B makes the following operations:

1) determining to switch the gas movement controlling valve 46 to the blocking state, and 2) to the determination result signal, inputting information which has determined to switch the gas movement controlling valve 46 to the blocking state.

After receiving the determination result signal, the switching instruction signal transmitter 48C makes the following operation: to the gas movement controlling valve 46, transmitting the information signal (including the determination result) as a switching instruction signal.

In other words, the controlling valve switching instructor 48 switches the allowing state with the blocking state and vice versa according to the engine speed information.

Other structures according to the fourth embodiment are substantially the same as those according to the first embodiment.

(Operation)

Then, operations of the intake air noise adjuster 1 according to the fourth embodiment are to be set forth. In the following description according to the fourth embodiment, the structural components other than the flow channel area changer 8, gas movement controlling valve 46 and member related thereto are substantially the same as those according to the first embodiment. Therefore, set forth hereinafter are mainly about the operations of the different components.

After the engine 10 is driven, the intake air pulsation caused according to the intake air operation by the engine 10 is propagated, via the intake manifold 22 and surge tank 20, to the gas present in the clean side intake air duct 14 (see FIG. 1).

Herein, during the idling or relaxed acceleration period, the engine side intake air negative pressure is more than or equal to the certain pressure since the opening of the throttle chamber 18 is small. As such, the pressure in the negative pressure introducing chamber 28 becomes negative (see FIG. 8).

Moreover, during the idling or relaxed acceleration period, the engine speed is less than the certain speed, thereby the controlling valve switching instructor 48 switches the gas movement controlling valve 46 to the allowing state (see FIG. 8).

The gas movement controlling valve 46 in the allowing state allows the communication between the clean side intake air duct 14 with the negative pressure introducing chamber 28, thus allowing the gas to move between the clean side intake air duct 14 and the negative pressure introducing chamber 28 (see FIG. 8).

Moreover, the negative pressure caused in the clean side intake air duct 14 and tanked in the negative pressure tank 50 renders the cylindrical part 36's space including the blocking plate biasing member 32 to have a negative pressure (see FIG. 8).

Rendering the cylindrical part 36's space including the blocking plate biasing member 32 to have a negative pressure shrinks the blocking plate biasing member 32 and thereby slide the blocking plate 30 relative to the inner periphery of the cylindrical part 36, thus moving the blocking plate 30 toward the base face of the cylindrical part 36 (see FIG. 8).

The blocking plate 30 moving toward the base face of the cylindrical part 36 rotates and thereby displaces the flow channel area changing part 24 in the communicating conduit 4, thus decreasing the flow channel area less than the maximum (see FIG. 8).

In this operation, the flow channel area changing part 24 contacting the inner periphery of the communicating conduit 4 blocks the clean side intake air duct 14 from the elastic body 6, thereby minimizing the flow channel area (see FIG. 8).

As such, the intake air pulsation caused according to the intake air operation by the engine 10 and propagated to the gas present in the clean side intake air duct 14 is suppressed from propagating to the elastic body 6, to thereby suppress vibration of the elastic body 6 (see FIG. 8).

Therefore, during the idling or relaxed acceleration period, the flow channel area is decreased from the maximum and the intake air pulsation propagated to the gas present in the clean side intake air duct 14 is suppressed from propagating to the elastic body 6, to thereby suppress vibration of the elastic body 6. Thereby, the effect of increasing the intake air noise can be relieved (see FIG. 8).

Moreover, during the idling or relaxed acceleration period, blocking the clean side intake air duct 14 from the elastic body 6 minimizes the flow channel area, thus greatly relieving the effect of increasing the intake air noise. As such, the intake air noise introduced into the vehicle compartment is rendered slight (see FIG. 8).

Meanwhile, during the rapid acceleration period, the opening of the throttle chamber 18 is large. As such, the intake air negative pressure caused in the gas in the clean side intake air duct 14 during the intake stroke of the engine 10 becomes greater than that caused during the relaxed acceleration period, rendering the engine side intake air negative pressure less than the certain pressure (see FIG. 9).

Moreover, during the rapid acceleration period having the engine speed more than or equal to the certain speed allows the controlling valve switching instructor 48 to switch the gas movement controlling valve 46 to the blocking state (see FIG. 9).

The gas movement controlling valve 46 in the blocking state blocks the clean side intake air duct 14 from the negative pressure introducing chamber 28, thus blocking the air from moving between the clean side intake air duct 14 and the negative pressure introducing chamber 28 (see FIG. 9), followed by the following operations (see FIG. 9):

1) the pressure of the cylindrical part 36's space including the blocking plate biasing member 32 is rendered from negative to positive, 2) elongating the blocking plate biasing member 32, and 3) allowing the blocking plate 30 to slide relative to the inner periphery of the cylindrical part 36 so as to move the blocking plate 30 to the communicating conduit 4 side.

The blocking plate 30 moving toward the communicating conduit 4 causes the following operations (see FIG. 9):

1) rotating and thereby displacing the flow channel area changing part 24 in the communicating conduit 4, 2) releasing the flow channel area changing part 24 from the inner periphery of the communicating conduit 4, and 3) communicating the clean side intake air duct 14 with the elastic body 6.

Then, the clean side intake air duct 14 communicating with the elastic body 6 such that the longitudinal direction of the flow channel area changing part 24 is substantially parallel to the lengthwise direction 4D of the communicating conduit 4 maximizes the flow channel area (see FIG. 9).

As such, the intake air pulsation caused according to the intake air operation by the engine 10 and propagated to the gas present in the clean side intake air duct 14 is propagated to the elastic body 6, thus vibrating the elastic body 6 facially outwardly. Then, the increased intake air noise is radiated outwardly to the external air 70 from the second open end of the communicating conduit 4 (see FIG. 1).

Therefore, during the rapid acceleration period, the flow channel area is maximized and the intake air pulsation propagated to the elastic body 6 vibrates the elastic body 6 facially outwardly, thus increasing the intake air noise which contributes to a production of the acceleration feeling (see FIG. 9).

(Effect of Fourth Embodiment)

(1) The intake air noise adjuster 1 according to the fourth embodiment allows the controlling valve switching instructor 48 to make the following operation:

Switching the allowing state (for allowing communication between the intake air duct 2 and the negative pressure introducing chamber 28) with the blocking state (for blocking the intake air duct 2 from the negative pressure introducing chamber 28) and vice versa, according to the engine speed information.

Not only according to the change of the engine side intake air negative pressure, the intake air noise adjuster 1 according to the fourth embodiment can control the state of displacing the flow channel area changing part 24 according to the engine speed information, thus changing the flow channel area.

As a result, the intake air noise adjuster 1 according to the fourth embodiment can accomplish, with higher accuracy than that brought about by the intake air noise adjuster 1 according to the first to third embodiments, both i) securing the silence during the relaxed acceleration or idling period and ii) increasing the intake air noise during the rapid acceleration period.

(2) Moreover, with the intake air noise adjuster 1 according to the fourth embodiment, the number of engine revolutions is defined as the engine speed information. Moreover, the controlling valve switching instructor 48 switches the gas movement controlling valve 46 to the allowing state when the engine speed is less than the certain speed while switches the gas movement controlling valve 46 to the blocking state when the engine speed is more than or equal to the certain speed.

As a result, the intake air noise adjuster 1 according to the fourth embodiment can accomplish, with high accuracy, both i) securing the silence during the relaxed acceleration or idling period and ii) improving the effect of increasing the intake air noise during the rapid acceleration period.

(Modifications)

(1) Like the intake air noise adjuster 1 according to the first embodiment, the intake air noise adjuster 1 according to the fourth embodiment includes the blocking plate 30 and blocking plate biasing member 32, but not limited thereto. Specifically, like the intake air noise adjuster 1 according to the second and third embodiments, the intake air noise adjuster 1 according to the fourth embodiment may include the elastic film part 44 (or 44*a*, 44*b*).

(2) With the intake air noise adjuster 1 according to the fourth embodiment, the ECU which is already installed to the vehicle serves as the controlling valve switching instructor 48, but not limited thereto. A special ECU for the controlling valve switching instructor 48 may be provided.

(3) With the intake air noise adjuster 1 according to the fourth embodiment, the number of revolutions of the engine 10 is defined as the speed information of the engine 10, but not limited thereto. Otherwise, for example, a vehicle speed or the engine 10's torque may be defined as the speed information of the engine 10.

(4) With the intake air noise adjuster 1 according to the fourth embodiment, the negative pressure tank 50 is disposed between the gas movement controlling valve 46 and the introducing conduit 34, but not limited thereto. The negative pressure tank 50 may be omitted from the fourth embodiment.

Fifth Embodiment (Structure)

Next, a fifth embodiment of the present invention is to be set forth.

Figure 10:
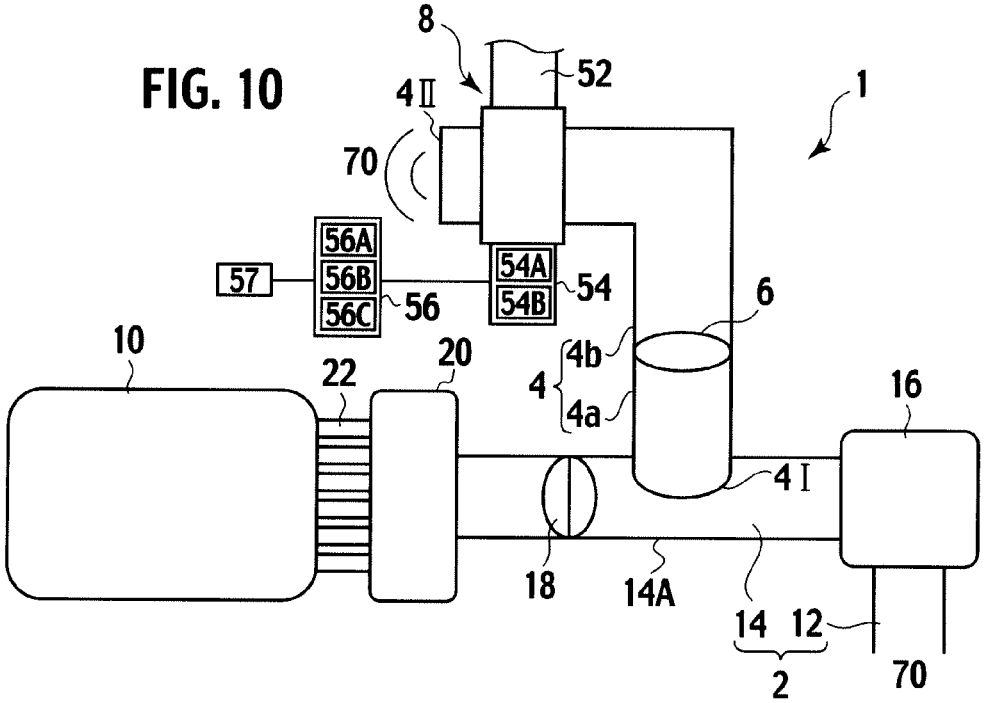
FIG. 10 shows an entire structural concept of the intake air noise adjuster, according to a fifth embodiment of the present invention.
Figure 11:
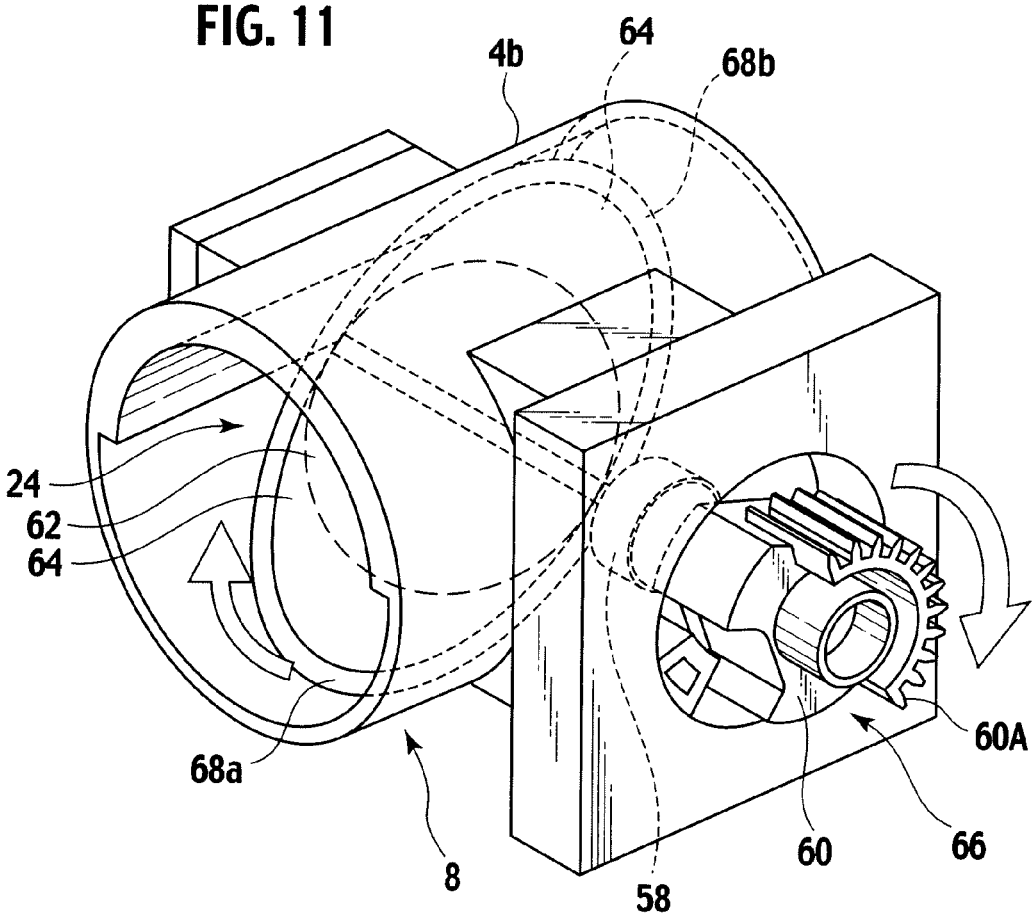
FIG. 11 shows a state of the flow channel area changer during the idling or relaxed acceleration period, according to the fifth embodiment of the present invention.
Figure 12:
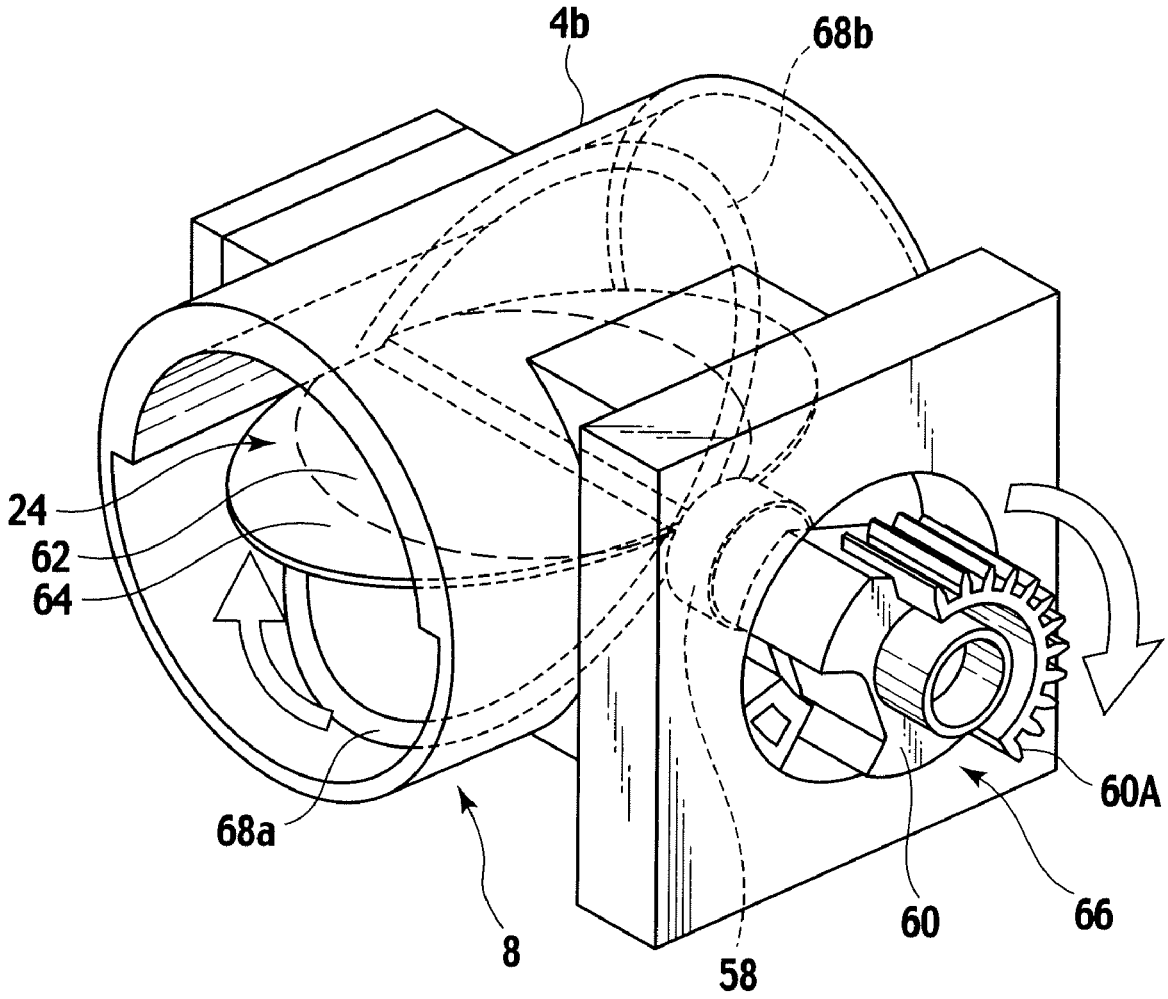
FIG. 12 shows a state of the flow channel area changer during the rapid acceleration period, according to the fifth embodiment of the present invention.

FIG. 10 to FIG. 12 each show a structure of the intake air noise adjuster 1, according to the fifth embodiment of the present invention. FIG. 10 shows an entire structural concept of the intake air noise adjuster 1. FIG. 11 shows a state of the flow channel area changer 8 during the relaxed acceleration or idling period, while FIG. 12 shows a state of the flow channel area changer 8 during the rapid acceleration period.

As shown in FIG. 10 to FIG. 12, the structure of the intake air noise adjuster 1 according to the fifth embodiment is substantially the same as that of the intake air noise adjuster 1 according to the first embodiment, other than that a supporting member 52 is provided for the fifth embodiment and that the structures of the flow channel area changer 8 and second communicating part 4*b* are different. Therefore, detailed explanations of the structure of the members other than the supporting member 52, the flow channel area changer 8, the second communicating part 4*b* and members related thereto are to be omitted.

As shown in FIG. 10, the flow channel area changer 8 mounted to the second communicating part 4*b* is disposed more on the external air 70 side than the elastic body 6 is disposed.

The supporting member 52 made, for example, of a high rigidity material such as metal and the like is formed into a column. A first end of the supporting member 52 is fixed to the flow channel area changer 8 while a second end of the supporting member 52 is fixed to a component (not shown) such as engine body, sub-frame and the like which are disposed in the engine room. With the above structure, the supporting member 52 suppresses (controls) the displacement of the flow channel area changer 8 in the engine room including the engine 10.

Moreover, the flow channel area changer 8 includes a gear rotor 54 and a rotary state controller 56. Structures of the gear rotor 54 and rotary state controller 56 are to be set forth afterward.

Moreover, as shown in FIG. 11 and FIG. 12, the flow channel area changer 8 includes the flow channel area changing part 24, a rotary shaft 58 and a gear 60. In FIG. 11 and FIG. 12, however, illustration of members other than the flow channel area changer 8 and second communicating part 4*b* are omitted for convenience' sake.

In the second communicating part 4*b*, the flow channel area changing part 24 is disposed more on the external air 70 side than the elastic body 6 is disposed.

Moreover, the flow channel area changing part 24 is a plate which is shaped substantially according to the cross section of the second communicating part 4*b*. The flow channel area changing part 24 includes a body 62 and a shape changing part 64 which are integrated.

From an axial direction of the second communicating part 4*b*, the shape changing part 64 is so viewed that a length from the gravity center to edge of the flow channel area changing part 24 changes, specifically, viewed substantially as a crescent having a length (from the gravity center to edge of the flow channel area changing part 24) becoming longer from the inner periphery of the second communicating part 4*b* to a position further away from the inner periphery. Therefore, the shape changing part 64 has such a structure that the flow channel area changing part 24 is elliptical when viewed in the axial direction of the second communicating part 4*b*.

The rotary shaft 58 penetrates through the second communicating part 4*b* in a radial direction of the second communicating part 4*b*. With the rotary shaft 58's axis turning toward the radial direction of the second communicating part 4*b*, the rotary shaft 58 is fixed to the flow channel area changing part 24 disposed in the second communicating part 4*b*. A position for fixing the rotary shaft 58 to the flow channel area changing part 24 includes the gravity center of the flow channel area changing part 24. As such, the rotary shaft 58 supports the flow channel area changing part 24 such that the flow channel area changing part 24 is supported to the second communicating part 4*b* in such a configuration as to displaceably rotate around the axis P intersecting with the lengthwise direction of the second communicating part 4*b*.

Outside the second communicating part 4*b*, a first end of the rotary shaft 58 is connected to the gear 60.

The gear 60 has an outer periphery formed with a plurality of teeth 60A. A part of the gear 60's outer periphery in a circumferential direction has a void part 66 which is free of the teeth 60A. In other words, the gear 60 has the teeth 60A only in a part of the outer periphery in the circumferential direction. For convenience' sake, FIG. 11 and FIG. 12 each omit illustration of a gear box for protecting the gear 60.

The gear rotor 54 has i) a gear part 54A adapted to be geared with the gear 60 and ii) a rotary driver 54B (otherwise referred to as "rotating force generator 54B") for driving the gear part 54A. The rotary driver 54B is, for example, a motor and the like. For convenience' sake, FIG. 11 and FIG. 12 each omit illustration of the gear rotor 54.

Receiving a rotary state controlling signal transmitted from the rotary state controller 56, the rotary driver 54B rotates the gear part 54A, according to the rotary state controlling signal. Rotating the gear part 54A rotates the gear 60. As such, the gear rotor 54 has such a function as to rotate the gear 60.

The rotary state controller 56 is, for example, an ECU which is already installed to the vehicle. The rotary state controller 56 includes an engine speed information detector 56A, a displacement state operator 56B, and a displacement state controlling signal transmitter 56C, as shown in FIG. 10. For convenience' sake, FIG. 11 and FIG. 12 each omit illustration of the rotary state controller 56.

In the driving of the engine 10, the engine speed information detector 56A makes the following operations:

1) as an engine speed information signal, receiving information signals (including engine speed information) sensed by an engine speed information sensor 57 (see FIG. 10), and 2) then, transmitting the thus received engine speed information signal to the displacement state operator 56B.

Herein, the fifth embodiment is to be set forth with the number of revolutions of the engine 10 defined as the engine speed information.

After receiving the engine speed information signal, the displacement state operator 56B makes the following operations:

1) based on the engine speed information included the thus received signal, operating the displacement state of the flow channel area changing part 24 in the second communicating part 4*b*, and 2) to the displacement state controlling signal transmitter 56C, transmitting the information signal (inducing the operation result) as a displacement state operating signal.

Specifically, displacement state operator 56B makes the following operations:

1) memorizing in advance a certain speed like the one according to the fourth embodiment, and 2) comparing i) the engine speed transmitted from the engine speed information detector 56A with ii) the certain speed.

Then, when the engine speed is less than the certain speed, the displacement state operator 56B makes the following operations:

1) operating the gear 60's rotary state which is obtained when the displacement state of the flow channel area changing part 24 is such that the flow channel area of the second communicating part 4*b* is decreased from the maximum, and 2) to the displacement state operating signal, inputting the information including the thus operated result.

Hereinabove, the number of resolutions or rotary angle of the gear 60 are, for example, defined as the rotary state of the gear 60.

Meanwhile, when the engine speed is more than or equal to the certain speed, the displacement state operator 56B makes the following operations:

1) operating the gear 60's rotary state which is obtained when the displacement state of the flow channel area changing part 24 is such that the flow channel area of the second communicating part 4*b* is maximized, and 2) to the displacement state operating signal, inputting the information including the thus operated result.

After receiving the displacement state operation, the displacement state controlling signal transmitter 56C transmits to the rotary state controller 56 the information signal (including the above operated result) as a rotary state controlling signal.

As set forth above, the rotary state controller 56 is capable of controlling the driving state of the gear rotor 54 according to the engine speed information.

Moreover, as shown in FIG. 11 and FIG. 12, the inner periphery of the second communicating part 4*b* is formed with a convex part 68*a* and a convex part 68*b* each of which is formed stepwise by changing thickness of the second communicating part 4*b*.

As shown in FIG. 11, on the inner periphery of the second communicating part 4*b*, each of the convex part 68*a* and convex part 68*b* is formed in a position to contact the flow channel area changing part 24 in a state that the flow channel area of the second communicating part 4*b* is minimized. Hereinabove, the state that the flow channel area of the second communicating part 4*b* is minimized allows the flow channel area changing part 24 to contact the inner periphery of the second communicating part 4*b*.

Moreover, each of the convex part 68*a* and convex part 68*b* has the following configuration: In the state that the flow channel area of the second communicating part 4*b* is minimized, the flow channel area changing part 24 and each of the convex part 68*a* and convex part 68*b* block the second communicating part 4*b* when viewed in the axial direction of the second communicating part 4*b*.

Other structural components according to the fifth embodiment are substantially the same as those according to the first embodiment.

(Operation)

Then, operations of the intake air noise adjuster 1 according to the fifth embodiment are to be set forth. In the following description according to the fifth embodiment, the structural components other than the flow channel area changer 8 are substantially the same as those according to the first embodiment. Therefore, set forth hereinafter are mainly about the operations of the different components.

After the engine 10 is driven, the intake air pulsation caused according to the intake air operation by the engine 10 is propagated, via the intake manifold 22 and surge tank 20, to the gas present in the clean side intake air duct 14 (see FIG. 10).

Herein, during the idling or relaxed acceleration period, the engine speed is less than the certain speed, thus allowing the rotary state controller 56 to control the driving state of the gear rotor 54, thereby the displacement state of the flow channel area changing part 24 is such that the flow channel area of the second communicating part 4*b* is decreased from the maximum. Specifically, the gear rotor 54 rotates the gear 60. Then, the flow channel area changing part 24 is inclined relative to the axial direction of the second communicating part 4*b* in the second communicating part 4*b* (see FIG. 11).

Then, increasing the flow channel area changing part 24's inclination relative to the axial direction of the second communicating part 4*b* accordingly decreases the flow channel area of the second communicating part 4*b* from the maximum (see FIG. 11).

Increasing the flow channel area changing part 24's inclination relative to the axial direction of the second communicating part 4*b* and thereby allowing the flow channel area changing part 24 to contact the convex part 68*a* and convex part 68*b* allows the flow channel area changing part 24 to contact the inner periphery of the second communicating part 4*b*, to thereby allow the flow channel area changing part 24 to block the elastic body 6 from the external air 70 side. In this state, the opening of the second communicating part 4*b* is minimized, thus minimizing the flow channel area of the second communicating part 4*b* (see FIG. 10 and FIG. 11).

Even in the following vibration of the elastic body 6, the increased intake air noise can be suppressed from radiating outwardly to the external air 70 from an open end of the second communicating part 4*b* (see FIG. 10 and FIG. 11): The intake air pulsation caused according to the intake air operation by the engine 10 and propagated to the gas present in the clean side intake air duct 14 vibrates the elastic body 6 facially outwardly.

Therefore, during the idling or relaxed acceleration period, the flow channel area is decreased from the maximum, thereby suppressing the increased intake air noise from radiating to the external air 70. Thereby, the effect of increasing the intake air noise can be relieved (see FIG. 10 and FIG. 11).

Moreover, during the idling or relaxed acceleration period, the elastic body 6 is blocked from the external air 70 side and the flow channel area of the second communicating part 4*b* is minimized, thus greatly relieving the effect of increasing the intake air noise. As such, the intake air noise introduced into the vehicle compartment is rendered slight (see FIG. 10 and FIG. 11).

Meanwhile, during the rapid acceleration period, the engine speed is more than or equal to the certain speed, thus deceasing the intake air negative pressure caused by the engine 10 (i.e., increasing an absolute value of intake air negative pressure). As such, the rotary state controller 56 controls the driving state of the gear rotor 54, thereby the displacement state of the flow channel area changing part 24 is such that the flow channel area of the second communicating part 4*b* is maximized. Specifically, the gear rotor 54 rotates the gear 60, then, the flow channel area changing part 24's inclination relative to the axial direction of the second communicating part 4*b* is decreased in the second communicating part 4*b*. As such, the flow channel area changing part 24 is moved from i) a first state where the flow channel area changing part 24 is inclined relative to the axial direction of the second communicating part 4*b* to ii) a second state where the flow channel area changing part 24 is parallel to the axial direction of the second communicating part 4*b* (see FIG. 12). FIG. 12 shows arrows for denoting the rotary directions of the flow channel area changing part 24, rotary shaft 58 and gear 60.

Moreover, decreasing the flow channel area changing part 24's inclination relative to the axial direction of the second communicating part 4*b* accordingly increases the flow channel area of the second communicating part 4*b* to the maximum (see FIG. 12).

Decreasing the flow channel area changing part 24's inclination relative to the axial direction of the second communicating part 4*b* and thereby allowing the flow channel area changing part 24 to be parallel to the axial direction of the second communicating part 4*b* allows the second communicating part 4*b* to have the maximum opening. In this state, the flow channel area of the second communicating part 4*b* is maximized (see FIG. 12).

As such, the intake air pulsation caused according to the intake air operation by the engine 10 and propagated to the gas present in the clean side intake air duct 14 propagates to the elastic body 6, thus vibrating the elastic body 6 facially outwardly. The increased intake air noise can be radiated outwardly to the external air 70 from the open end of the second communicating part 4*b* (see FIG. 10 and FIG. 12).

Therefore, during the rapid acceleration period, the flow channel area of the second communicating part 4*b* is maximized, thereby allowing the intake air pulsation propagated to the elastic body 6 to vibrate the elastic body 6 facially outwardly, thus increasing the intake air noise which contributes to a production of the acceleration feeling (see FIG. 10 and FIG. 12).

(Effect of the Fifth Embodiment)

(1) The intake air noise adjuster 1 according to the fifth embodiment having the flow channel area changing part 24 disposed more on the external air 70 side than the elastic body 6 is disposed brings about the following effect: Even when the flow channel area changing part 24 is damaged and thereby dismounting the flow channel area changing part 24's components from the communicating conduit 4, the elastic body 6 can block the thus dismounted components from moving to the intake air passage 2 side.

As such, the flow channel area changing part 24 can be prevented from being suck to the engine 10.

As a result, a critical failure mode requiring stop of the engine 1 can be prevented even when the flow channel area changing part 24 is damaged or the like, thus preventing a critical failure in terms of safety.

(2) Moreover, the intake air noise adjuster 1 according to the fifth embodiment having the flow channel area changer 8 fixed to the vehicle side members by way of the supporting member 52 can prevent the flow channel area changer 8 from being displaced in the engine room including the engine 1.

As a result, the flow channel area changer 8 can be prevented from an interference with the members in the engine room such as engine 10, thereby suppressing damage to the members in the engine room.

(3) Moreover, the intake air noise adjuster 1 according to the fifth embodiment includes the gear rotor 54 (for rotating the gear 60 connected to the rotary shaft 58 fixed to the flow channel area changing part 24) and the rotary state controller 56 (for controlling the driving state of the gear rotor 54 according to the engine speed information) makes the following effect:

Thus, the rotary state of the flow channel area changing part 24 can be controlled according to the engine speed information, thus changing the flow channel area of the communicating conduit 4.

As a result, the intake air noise adjuster 1 according to the fifth embodiment can accomplish, with high accuracy, both i) securing the silence during the relaxed acceleration or idling period and ii) improving the effect of increasing the intake air noise during the rapid acceleration period.

(4) Moreover, the intake air noise adjuster 1 according to the fifth embodiment defines the number of engine revolutions as the engine speed information. Moreover, the rotary state controller 56 controls the driving state of the gear rotor 54 in the following manner:

1) when the engine speed is less than the certain speed, the flow channel area is decreased from the maximum, and 2) when the engine speed is more than or equal to the certain speed, the flow channel area is maximized.

As a result, according to the engine speed, the intake air noise adjuster 1 of the fifth embodiment can accomplish, with high accuracy, both i) securing the silence during the relaxed acceleration or idling period and ii) improving the effect of increasing the intake air noise during the rapid acceleration period.

(5) Moreover, with the intake air noise adjuster 1 according to the fifth embodiment, the flow channel area changing part 24 includes the shape changing part 64 which is so viewed in the axial direction of the communicating conduit 4 that a length from the gravity center to edge of the flow channel area changing part 24 changes. Moreover, the shape changing part 64 is so formed that the flow channel area changing part 24 is elliptical when viewed in the axial direction of the communicating conduit 4.

As such, when the flow channel area changing part 24 blocks the communicating conduit 4, the flow channel area changing part 24 is inclined relative to the axial direction of the communicating conduit 4, thus decreasing the rotary angle of the flow channel area changing part 24.

As a result, the flow channel area changing part 24 can be rotated in the communicating conduit 4 in a short period, thus making it possible to switch the increasing and suppressing of the intake air noise with a good response.

(6) Moreover, with the intake air noise adjuster 1 according to the fifth embodiment, the shape changing part 64 is so formed that the flow channel area changing part 24 is elliptical when viewed in the axial direction of the communicating conduit 4. As such, when the flow channel area changing part 24 blocks the communicating conduit 4, the flow channel area changing part 24 is inclined relative to the axial direction of the communicating conduit 4. Moreover, when the flow channel area of the communicating conduit 4 is maximized, the flow channel area changing part 24 is parallel to the axial direction of the communicating conduit 4.

Therefore, without the need of forming teeth 60A around the entire outer periphery of the gear 60, the flow channel area changing part 24 can be rotated in the communicating conduit 4 such that the flow channel area changes from the minimum to maximum.

As such, with the intake air noise adjuster 1 according to the fifth embodiment, the gear 60 can be so configured that the teeth 60A are formed only partly on the outer periphery.

As such, the rotary speed of the gear 60 with the teeth 60A partly formed is faster in rotary speed than with the teeth 60A entirely formed.

As a result, the flow channel area changing part 24 can be rotated in a short period in the communicating conduit 4, thus making it possible to switch the increasing and suppressing of the intake air noise with a good response.

(7) Moreover, the intake air noise adjuster 1 according to the fifth embodiment has such a structure that the inner periphery of the communicating conduit 4 is formed with the convex parts 68*a*, 68*b* which contact the flow channel area changing part 24 when the flow channel area of the communicating conduit 4 is minimized.

As such, when the flow channel area changing part 24 blocks the communicating conduit 4, the flow channel area changing part 24 can be overlapped with the communicating conduit 4 in the axial direction of the communicating conduit 4, thus securely insulating the noise which is progressing in the axial direction of the communicating conduit 4.

As a result, silence can be accurately secured during the relaxed acceleration or idling period.

(8) Moreover, with the intake air noise adjuster 1 according to the fifth embodiment, each of the convex part 68*a* and convex part 68*b* on the inner periphery of the communicating conduit 4 are formed stepwise by changing thickness of the communicating conduit 4.

As such, the convex part 68*a* and convex part 68*b* each can serve as a stopper for stopping the flow channel area changing part 24. Moreover, thus integrating the communicating conduit 4 with the convex part 68*a* and convex part 68*b* can increase rigidity of the convex part 68*a* and convex part 68*b*.

As a result, friction between the flow channel area changing part 24 and the communicating conduit 4's inner periphery can be suppressed, thus suppressing the damage to the flow channel area changing part 24 as well as the damage to the convex part 68*a* and convex part 68*b*.

(Modifications)

Figure 13:
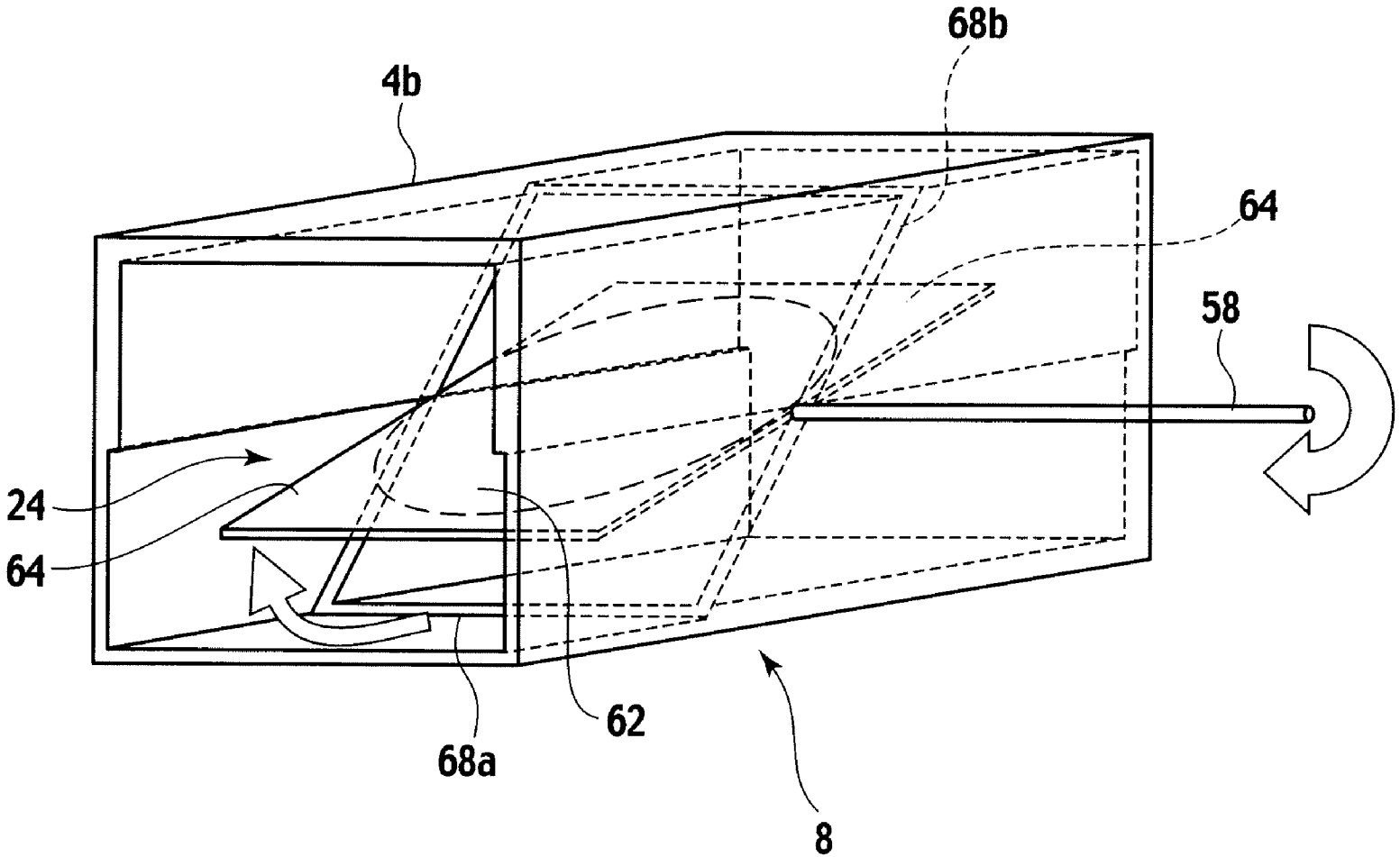
FIG. 13 shows a modification of the intake air noise adjuster, according to the fifth embodiment of the present invention.

(1) Moreover, with the intake air noise adjuster 1 according to the fifth embodiment, the shape changing part 64 is so formed that the flow channel area changing part 24 is elliptical when viewed in the axial direction of the second communicating part 4*b*, but not limited thereto. Otherwise, for example, the shape changing part 64 may be so formed that the flow channel area changing part 24 is rectangular when viewed in the axial direction of the second communicating part 4*b*, as shown in FIG. 13. In this case, as shown in FIG. 13, the communicating conduit 4 is so formed as to have a square cross section. The essence is that the shape changing part 64 is so formed that the length from the gravity center to edge of the flow channel area changing part 24 changes in the axial direction of the second communicating part 4*b*. Hereinabove, FIG. 13 shows a modification of the fifth embodiment. FIG. 13 shows arrows denoting directions of rotating the flow channel area changing part 24 and rotary shaft 58.

(2) Moreover, with the intake air noise adjuster 1 according to the first embodiment, the rotary shaft 58 is rotated via the gear 60, but not limited thereto. Otherwise, the rotary shaft 58 may be rotated by changing the intake air negative pressure, as set forth in each of the aforementioned embodiments.

(3) Moreover, with the intake air noise adjuster 1 according to the fifth embodiment, the convex part 68*a* and convex part 68*b* on the inner periphery of the communicating conduit 4 are formed stepwise by changing thickness of the communicating conduit 4, but not limited thereto. Otherwise, the convex part 68*a* and the convex part 68*b* each may be a separated part from the communicating conduit 4 and mounted to the inner periphery of the communicating conduit 4.

Although the present invention has been described above by reference to five embodiments and modifications thereof, the present invention is not limited to the embodiments and modifications thereof described above. Further modifications or variations of those described above will occur to those skilled in the art, in light of the above teachings.

This application is based on prior Japanese Patent Application Nos. P2007-194256 (filed on Jul. 26, 2007 in Japan) and P2008-075266 (filed on Mar. 24, 2008 in Japan). The entire contents of the Japanese Patent Application Nos. P2007-194256 and P2008-075266 from which priorities are claimed are incorporated herein by reference, to take protection against translation errors or omitted portions.

The scope of the present invention is defined with reference to the following claims.

What is claimed is:

1. An intake air noise adjuster comprising:

a communicating conduit including:

a first end configured to communicate with an intake air passage to an engine, and a second end configured to communicate with external air;

an elastic body configured to block the communicating conduit; and a flow channel area changer configured to change a flow channel area of the communicating conduit based on a change of an intake air negative pressure caused in the intake air passage, wherein the flow channel area changer cooperates with the communicating conduit to define the flow channel area at a point distant from the elastic body.

2. The intake air noise adjuster according to claim 1, wherein, when the intake air negative pressure is less than a certain pressure, the flow channel area changer is configured to substantially maximize the flow channel area of the communicating conduit to a substantial maximum, and wherein, when the intake air negative pressure is more than or equal to the certain pressure, the flow channel area changer is configured to decrease the flow channel area of the communicating conduit to an amount less than the substantial maximum.

3. The intake air noise adjuster according to claim 1, wherein the flow channel area changer includes:

a flow channel area changing part disposed in the communicating conduit, the flow channel area changing part being configured to be displaced in the communicating conduit so as to change the flow channel area by changing an opening of the communicating conduit, and a displacer configured to displace the flow channel area changing part by the change of the intake air negative pressure.

4. The intake air noise adjuster according to claim 3, wherein the displacer includes:

a negative pressure introducing chamber which is mounted to an outer periphery of the intake air passage in a position closer to the engine than a throttle chamber for increasing or decreasing an intake air amount of the engine is mounted, and an opening changer, wherein, when the intake air negative pressure is more than or equal to a certain pressure, the opening changer is configured to displace the flow channel area changing part in a direction for decreasing the opening of the communicating conduit, and wherein, when the intake air negative pressure is less than the certain pressure, the opening changer is configured to displace the flow channel area changing part in a direction for increasing the opening of the communicating conduit.

5. The intake air noise adjuster according to claim 4, wherein the opening changer includes:

a blocking plate configured to block the negative pressure introducing chamber, the blocking plate being connected to the flow channel area changing part, and a blocking plate biasing member configured to pressingly bias the blocking plate such that, when the intake air negative pressure is less than the certain pressure, the flow channel area changing part is displaced in the direction for increasing the opening of the communicating conduit.

6. The intake air noise adjuster according to claim 4, wherein the opening changer includes an elastic film part configured to block the negative pressure introducing chamber, wherein the elastic film part is connected to the flow channel area changing part, and wherein the elastic film part is configured to be elastically deformed facially outwardly by the change of the intake air negative pressure.

7. The intake air noise adjuster according to claim 4, further comprising:

a gas movement controlling valve configured to switch between an allowing state for allowing the intake air passage to communicate with the negative pressure introducing chamber, and a blocking state for blocking the intake air passage from the negative pressure introducing chamber, and a controlling valve switching instructor configured to switch the allowing state and the blocking state of the gas movement controlling valve according to speed information of the engine.

8. The intake air noise adjuster according to claim 7, wherein, with a number of revolutions of the engine as the speed information of the engine, the controlling valve switching instructor is configured to switch the gas movement controlling valve to the allowing state when speed of the engine is less than a certain speed, and wherein the controlling valve switching instructor is configured to switch the gas movement controlling valve to the blocking state when the speed of the engine is more than or equal to the certain speed.

9. The intake air noise adjuster according to claim 3, wherein the flow channel area changer includes a rotary shaft configured to be fixed to the flow channel area changing part in a state of the rotary shaft being directed in a radial direction of the communicating conduit, and wherein the displacer includes a rotating force generator configured to rotate the rotary shaft as a result of the change of the intake air negative pressure.

10. The intake air noise adjuster according to claim 1, wherein the flow channel area changer includes:

a flow channel area changing part disposed in the communicating conduit, the flow channel area changing part being configured to be displaced in the communicating conduit so as to change the flow channel area by changing an opening of the communicating conduit, a rotary shaft configured to be fixed to the flow channel area changing part in a state of the rotary shaft being directed in a radial direction of the communicating conduit, a gear connected to the rotary shaft, a gear rotor configured to rotate the gear, and a rotary state controller configured to control rotation of the gear rotor according to speed information of the engine.

11. The intake air noise adjuster according to claim 10, wherein, with a number of revolutions of the engine as the speed information of the engine, the rotary state controller is configured to control the rotation of the gear rotor such that the flow channel area is decreased from a substantial maximum thereof when a speed of the engine is less than a certain speed, and wherein the rotary state controller is configured to control the rotation of the gear rotor such that the flow channel area is substantially maximized when the speed of the engine is more than or equal to the certain speed.

12. The intake air noise adjuster according to claim 10, wherein the gear has a tooth partly on a periphery of the gear.

13. The intake air noise adjuster according to claim 3, wherein the intake air noise adjuster comprises a plurality of the flow channel area changers.

14. The intake air noise adjuster according to claim 3, wherein the flow channel area changing part is formed of a plate member, and wherein the flow channel area changing part is provided to the communicating conduit in such a configuration as to rotate around an axis intersecting with a lengthwise direction of the communicating conduit.

15. The intake air noise adjuster according to claim 14, wherein the flow channel area changing part includes a shape changing part having a length from a gravity center of the flow channel area changing part to an edge of the flow channel area changing part that changes when the shape changing part is viewed from an axial direction of the communicating conduit.

16. The intake air noise adjuster according to claim 15, wherein the shape changing part is so formed that the flow channel area changing part is substantially elliptical when the flow channel area changing part is viewed from the axial direction of the communicating conduit.

17. The intake air noise adjuster according to claim 3, wherein the flow channel area changing part is disposed on an external air side of the elastic body.

18. The intake air noise adjuster according to claim 3, wherein a convex part is formed on an inner face of the communicating conduit, and wherein the convex part is configured to contact the flow channel area changing part when the flow channel area is substantially minimized.

19. The intake air noise adjuster according to claim 18, wherein the convex part is a step of an inner periphery of the communicating conduit, the step being formed by changing a thickness of the communicating conduit.

20. The intake air noise adjuster according to claim 1, wherein the communicating conduit includes:

a first communicating part configured to communicate with the intake air passage, and a second communicating part disposed on an external air side of the first communicating part.

21. The intake air noise adjuster according to claim 20, wherein the second communicating part is larger in cross section than the first communicating part.

22. The intake air noise adjuster according to claim 20, wherein the second communicating part is different in length from the first communicating part.

23. The intake air noise adjuster according to claim 1, further comprising a supporting member configured to connect the flow channel area changer with a component which is disposed in an engine room where the engine is disposed.

24. An intake air noise adjuster comprising:

a communicating means including:

a first end communicating to an intake air means to an engine, and a second end communicating to an external air;

an elastic means for blocking the communicating means; and a flow channel area changing means for changing a flow channel area of the communicating means based on a change of an intake air negative pressure caused in the intake air means, wherein the flow channel area changing means cooperates with the communicating means to define the flow channel area at a point distant from the elastic means.

25. The intake air noise adjuster as claimed in claim 1, wherein the point where the flow channel area is located is between the first end of the communicating conduit and the elastic body.

26. The intake air noise adjuster as claimed in claim 1, wherein the point where the flow channel area is located is between the second end of the communicating conduit and the elastic body.

27. An apparatus for adjusting sound derived from intake air pulsation within an intake air passage connected to an engine, the apparatus comprising:

a conduit including a first end and a second end;

an elastic body mounted to the conduit between the first end and the second end to block the conduit, the elastic body including a portion configured to vibrate in response to the intake air pulsation propagated into the conduit via the first end; and a flow channel area changing device having a first state in which a flow channel area within the conduit distant from the elastic body is minimized to minimize propagation of noise outwardly via the second end, and a second state in which the flow channel area is maximized to maximize propagation of noise outwardly via the second end.

28. The apparatus as claimed in claim 27, wherein the flow channel area is disposed between the first end and the elastic body so as to control propagation of the intake air pulsation to the elastic body.

29. The apparatus as claimed in claim 27, wherein the flow channel area is disposed between the elastic body and the second end so as to control propagation of noise outwardly via the second end.

30. An apparatus for adjusting sound derived from intake air pulsation within an intake air passage connected to an engine, the apparatus comprising:

a conduit including a first end and a second end;

an elastic body mounted to the conduit between the first end and the second end to block the conduit, the elastic body including a portion configured to vibrate in response to the intake air pulsation propagated into the conduit via the first end; and means for controlling a flow channel area within the conduit distant from the elastic body between a first state in which the flow channel area is minimized to minimize propagation of noise outwardly via the second end and a second state in which the flow channel area is maximized to maximize propagation of noise outwardly via the second end.

31. The apparatus as claimed in claim 30, wherein the flow channel area is disposed between the first end and the elastic body such that propagation of the intake air pulsation to the elastic body is controlled.

32. The apparatus as claimed in claim 30, wherein the flow channel area is disposed between the elastic body and the second end such that propagation of noise outwardly via the second end is controlled.

33. The apparatus as claimed in claim 31, wherein the means for controlling the flow channel area includes a vacuum actuator.

34. The apparatus as claimed in claim 32, wherein the means for controlling the flow channel area includes a motor.

* * * * *